US007874752B2

(12) United States Patent
Kawabe et al.

(10) Patent No.: US 7,874,752 B2
(45) Date of Patent: Jan. 25, 2011

(54) PRINTER

(75) Inventors: Noriko Kawabe, Nagoya (JP); Hakudai Kondo, Nagoya (JP); Shinji Kobayashi, Tokai (JP); Susumu Murata, Toyoake (JP); Masato Kato, Kasugai (JP); Atsushi Kasugai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 265 days.

(21) Appl. No.: 11/530,784

(22) Filed: Sep. 11, 2006

(65) Prior Publication Data

US 2007/0059087 A1 Mar. 15, 2007

(30) Foreign Application Priority Data

Sep. 9, 2005 (JP) ..... 2005-261838

(51) Int. Cl.
*B41J 29/02* (2006.01)
*B41J 25/304* (2006.01)

(52) U.S. Cl. ..... 400/693; 400/691; 347/108; 347/222

(58) Field of Classification Search ..... 400/691, 400/693; 347/108, 222
See application file for complete search history.

(56) References Cited

U.S. PATENT DOCUMENTS 4,974,033 A * 11/1990 Yamada et al. ..... 399/124
5,502,477 A 3/1996 Osada et al.
5,876,129 A 3/1999 Suzuki
6,739,683 B2 * 5/2004 Shimomura et al. ..... 347/8
6,848,850 B2 * 2/2005 Matsuo et al. ..... 400/693
7,245,869 B2 * 7/2007 Kim et al. ..... 399/377
7,566,124 B2 * 7/2009 Kan et al. ..... 347/104
2003/0223794 A1 12/2003 Shirota et al.
2005/0175388 A1 8/2005 Namekawa et al.
2005/0225025 A1 * 10/2005 Chikumoto ..... 271/162
2006/0083566 A1 * 4/2006 Hwang ..... 399/391

FOREIGN PATENT DOCUMENTS

JP S59-176562 U 11/1984

(Continued)

OTHER PUBLICATIONS

European Patent Office, European Search Report for Related EP Application No. 06018218 dated Nov. 24, 2006.

(Continued)

*Primary Examiner*—Leslie J Evanisko
*Assistant Examiner*—Marissa L Ferguson-Samreth
(74) *Attorney, Agent, or Firm*—Baker Botts L.L.P.

(57) ABSTRACT

It is intended to provide a printer which can prevent dust from entering and adhering to a printing medium, thereby avoiding entry of the dust to or near a print head, and can improve print quality. A first cover covers a first paper projection port through which paper as the printing medium is projected when the paper is inside a housing. This can prevent the entry of the dust through the first paper projection port to the housing. Furthermore, the first cover swings about a first engagement portion by pressure of a front end of the paper to cover the paper when the paper is projected through the first paper projection port in the forward feeding motion by the feeding device such as a paper feeding roller.

10 Claims, 19 Drawing Sheets

PAPER REACHES PRINT START POSITION

FOREIGN PATENT DOCUMENTS

| | | | |
|---|---|---|---|
| JP | H02-127454 | U | 10/1990 |
| JP | H05-029760 | U | 4/1993 |
| JP | H06-255861 | A | 9/1994 |
| JP | H06-270504 | A | 9/1994 |
| JP | H08-067354 | A | 3/1996 |
| JP | H8-118755 | A | 5/1996 |
| JP | H10-278324 | A | 10/1998 |
| JP | H10-278325 | A | 10/1998 |
| JP | 2004-115193 | A | 4/2004 |
| JP | 2005-074705 | A | 3/2005 |

OTHER PUBLICATIONS

Japan Patent Office; Office Action in Japanese Patent Application No. 2005-261838 (counterpart to the above captioned US application) mailed Jun. 22, 2010.

* cited by examiner

AFTER FRONT END OF PAPER REACHES PLATEN ROLLER

PAPER REACHES PRINT START POSITION

PRINTER

CROSS-REFERENCE TO RELATED APPLICATIONS

This application claims priority from JP 2005-261838, filed Sep. 9, 2005, the contents of which are hereby incorporated by reference.

TECHNICAL FIELD

The disclosure relates to a printer which prints on a printing medium in a forward and backward feeding motion, especially to a protective cover provided in the printer for covering a printing surface of the printing medium which is moved forward and backward.

BACKGROUND

Conventionally, protection against dust has been one of solutions for improvement of print quality of a printing medium to be printed by a printer. A compact printer for instant printing of pictures taken by a digital camera has been significantly developed with a proliferation of the digital camera. This printer is so compact that it hardly has a space in which the printing medium is moved forward and backward to the inside of the printer. Therefore, the printer needs to print on the printing medium, projecting the printing medium from a housing of the printer. This causes the entry of dust through a delivery port and the dust having adhered to the printing medium to be moved to a print head, which result in the deterioration in the print quality of the printing medium.

To prevent the entry of the dust through the delivery port for the printing medium, for instance, a paper discharge port protector of printer is disclosed in the Japanese patent application laid-open No. H8 (1996)-118755. The paper discharge port protector of printer comprises paper discharge guides which guide the paper discharged by discharge rollers to a paper discharge port, and a lid member which is freely movable between a close position for covering the paper discharge port and an open position for opening the paper discharge port so that paper can be discharged, and which guides the paper to be discharged upward through the paper discharge port.

The lid member which guides the paper upward through the paper discharge port in the '755 publication is effective in a use only for discharging the paper. However, in a printer for performing printing such as color printing on the paper as the printing medium by several times of the forward and backward feeding motions, dust tends to enter from above since there is an open space above the paper as the printing medium. Accordingly, the lid member cannot prevent the dust from adhering to the printing medium to be moved to the print head, which damages the print quality of the paper significantly.

SUMMARY

The disclosure has been made in view of the above circumstances and has an object to overcome the above problems and to provide a printer which can perform printing such as color printing on a printing medium in one or more forward and backward feeding motions while projecting the printing medium through a housing of the printer, and can prevent dust from entering and adhering to the printing medium, thereby avoiding the entry of the dust to or near the print head.

To achieve the purpose of the disclosure, there is provided a printer comprising: a printing device; a printing medium to be printed by the printing device; a feeding device that feeds the printing medium forward and backward; a housing that covers the printing device and the feeding device and that is provided with a first engagement portion; a first paper projection port provided in the housing, through which the printing medium is temporarily projected outside the housing; and a first cover arranged to swing about the first engagement portion by pressure of a front end of the printing medium when projected through the first paper projection port in forward feeding motion by the feeding device to cover the projected printing medium.

The printer according to the first aspect comprises the first cover which swings about the first engagement portion provided in the housing. With this arrangement, the first cover covers the first paper projection port through which the printing medium is projected when the printing medium is inside the housing. This can prevent the entry of dust through the first paper projection port to the housing. Furthermore, the first cover swings about the first engagement portion by pressure of the front end of the printing medium to cover the printing medium when the printing medium is projected through the first paper projection port in the forward feeding by the feeding device. This makes it possible to prevent dust from adhering to the printing medium to be moved to the print head, which can improve the print quality.

DETAILED DESCRIPTION

Figure 1:
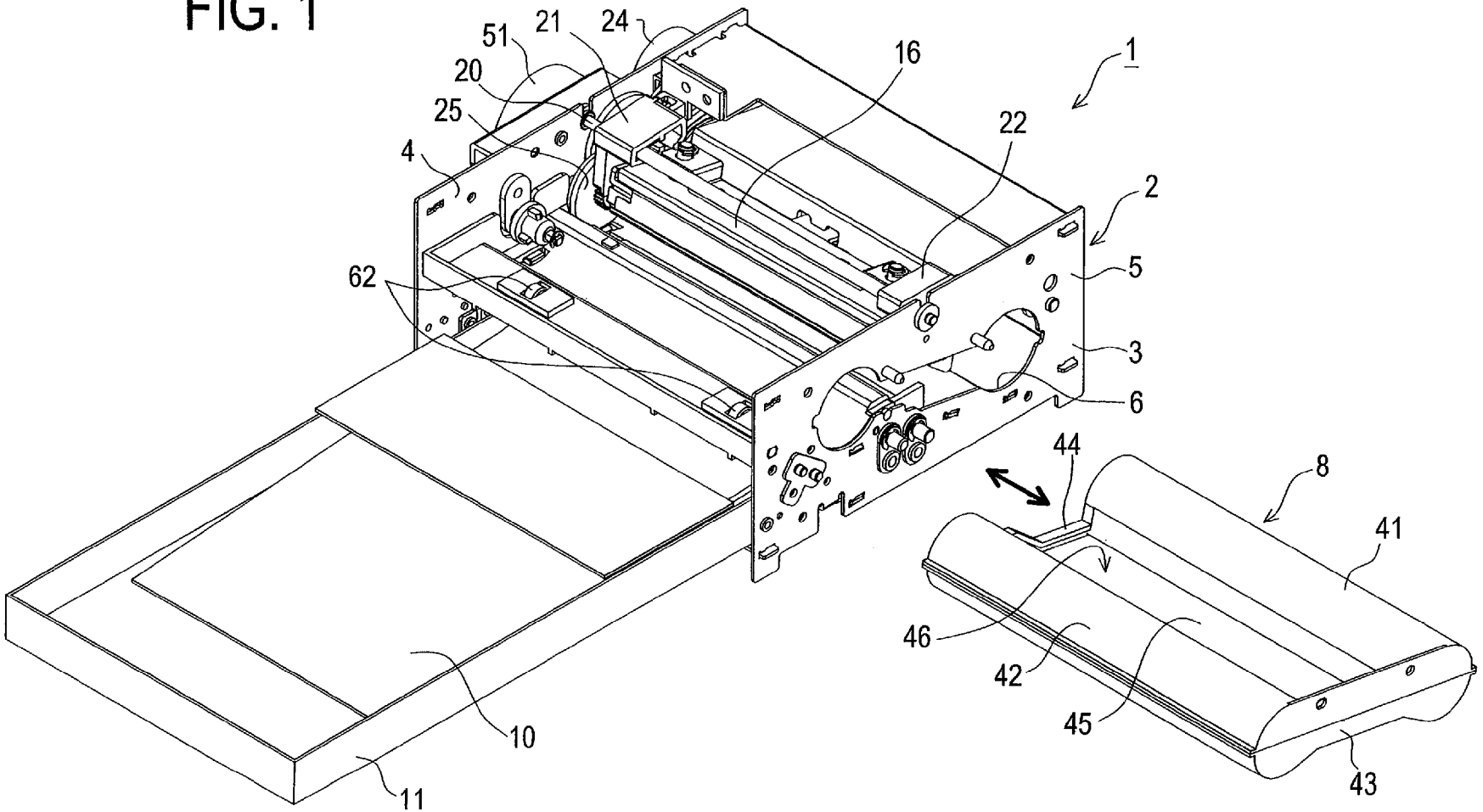
FIG. 1 is a perspective view showing a schematic structure of a printer and a ribbon cassette of an exemplary embodiment.
Figure 2:
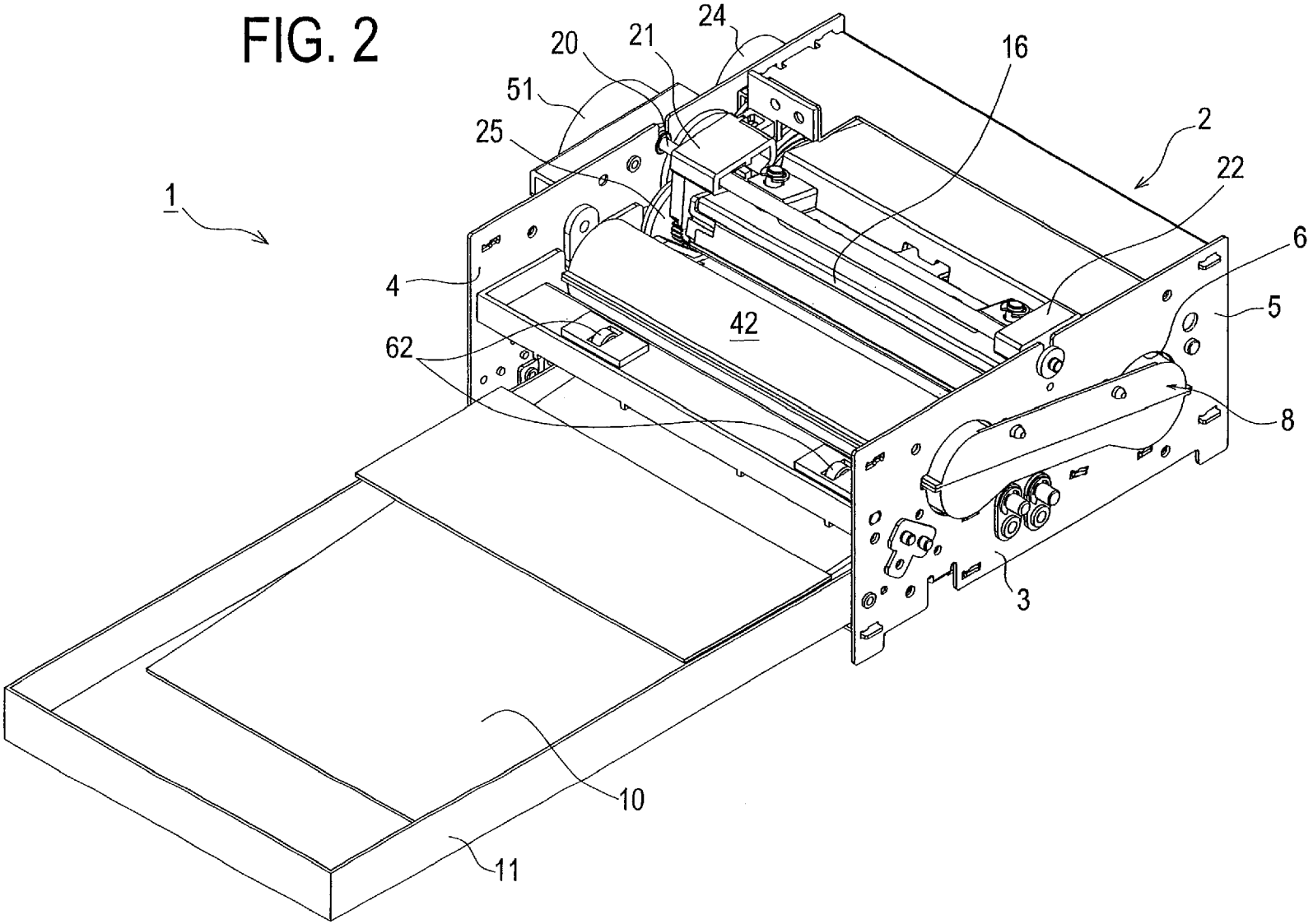
FIG. 2 is a perspective view of the printer in which the ribbon cassette is installed.
Figure 3:
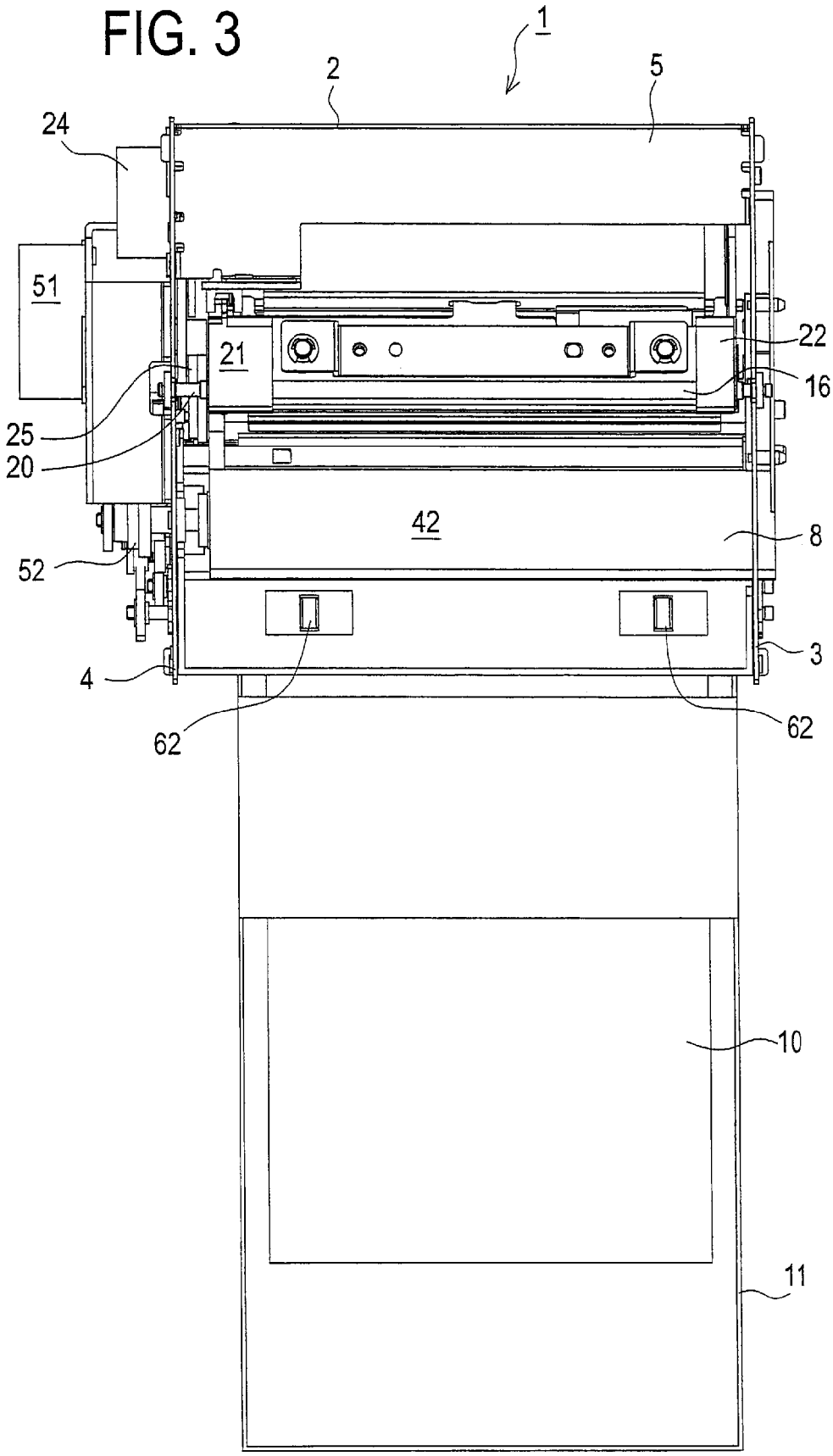
FIG. 3 is a plan view of the printer in which the ribbon cassette is installed.

A detailed description of an exemplary embodiment of a printer of the disclosure will now be given referring to the accompanying drawings.

Firstly, a schematic structure of the printer of the disclosure will be explained with reference to FIGS. 1 to 11.

As shown in FIGS. 1 to 5, a printer 1 comprises a main body structure 2, a ribbon cassette 8, a paper tray 11 and a housing 7. The main body structure 2 is composed of a frame 5 having side walls 3, 4 provided on either side of the printer 1. The ribbon cassette 8 can be removably installed in the frame 5 by being inserted from the side into an oblong ribbon cassette hole 6 penetrated through the side wall 3. The paper tray 11 for holding plural sheets of paper 10 as a printing medium in a stacked relation is fitted into a lower part of a front side of the main body structure 2 from the front side, and thus attached thereto. The housing 7 covers the main body structure 2.

The housing 7 is provided with a first paper projection port 19 for a forward feeding motion and a second paper projection port 23 for a backward feeding motion. The paper 10 as the printing medium is moved forward and backward during printing so that it is projected from the housing 7 through the paper projection ports 19, 23 in the forward and backward feeding motions respectively. In order to cover and protect the paper 10 when projected, a first cover 12 and a second cover 27, which will be mentioned in detail later, are hingedly connected to the housing 7. Specifically, the first cover 12 swings about a first engagement portion 9 provided in the housing 7 to close the first paper projection port 19 in the forward feeding motion. Also, the second cover 27 swings about a third engagement portion 26 provided in the housing 7 to close the second paper projection port 23 in the backward feeding motion (see FIG. 4).

It is noted that a base material of the paper 10 is preferably 0.18 mm or more in thickness since it pushes outward the first cover 12 and the second cover 27 in the forward and backward feeding directions respectively.

A head unit 16 having a long thermal head 15 at a lower front end portion is provided in an upper part of the main body structure 2, facing to the ribbon cassette 8. A back end of the head unit 16 is rotatably fixed to a turning shaft 17 of which both ends are supported by the side walls 3, 4. Torsion springs 18 are wound on the turning shaft 17. One ends of the torsion springs 18 are held by the side walls 3, 4, and the other ends thereof are hooked on back ends 31A, 32A of side walls 31, 32 of the head unit 16 described later. The head unit 16 is forcibly turned about the turning shaft 17 in a clockwise direction in FIG. 4 by the torsion springs 18 wound on the turning shaft 17.

On both sides of the head unit 16 in a longitudinal direction, there is provided a pair of cam members 21, 22 fixed to a turning shaft 20 of which both ends are pivotally supported by upper end portions of the side walls 3, 4 of the frame 5.

Figure 4:
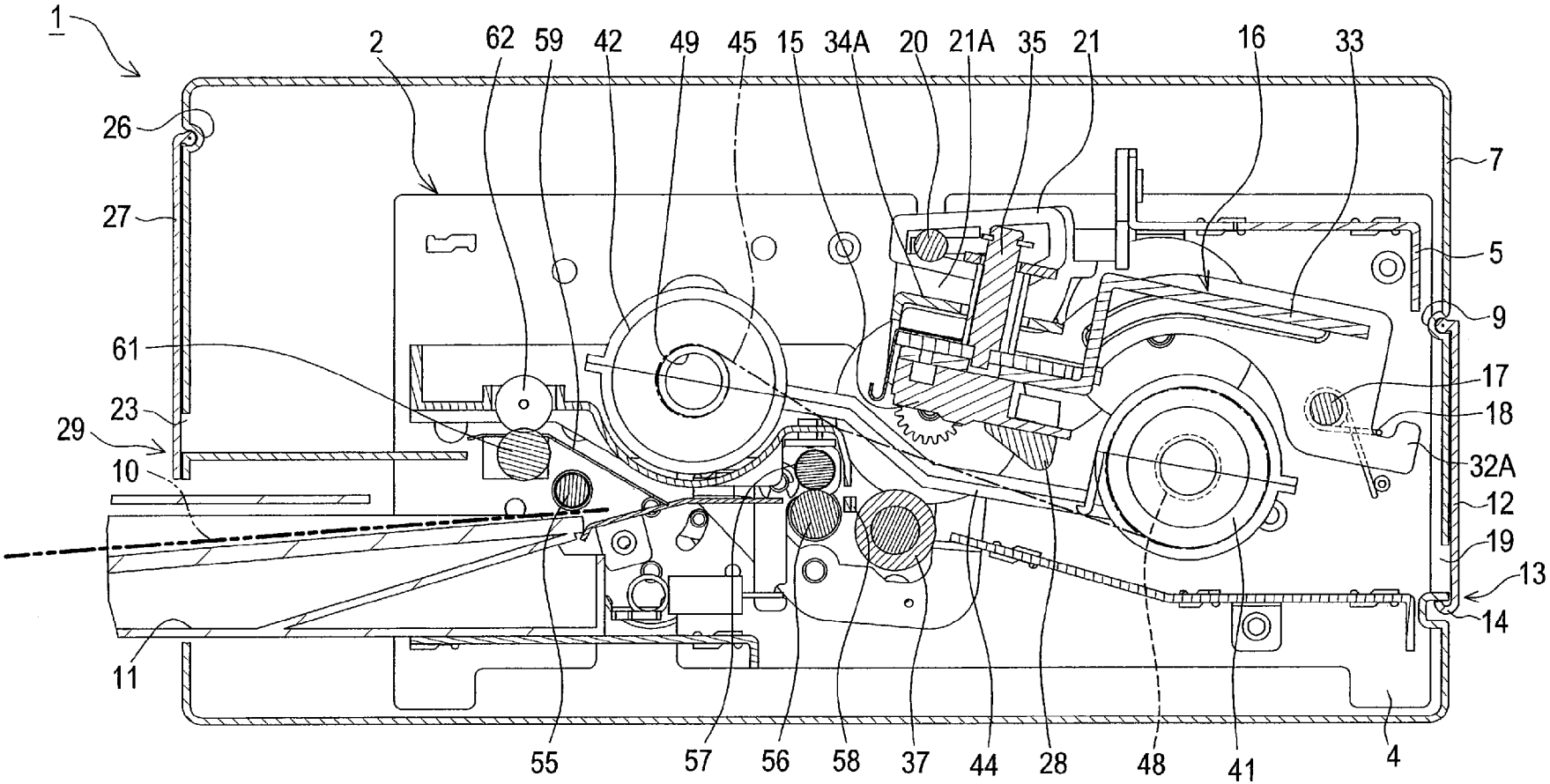
FIG. 4 is a sectional side view of the printer with a housing in which the ribbon cassette is installed.

As shown in FIGS. 8 to 11, the cam members 21, 22 are formed substantially in rectangular shapes in side view. Each one edge of the cam members 21, 22 is fixed to the turning shaft 20. The other edges of the cam members 21, 22 are formed in round shapes, which are brought into contact with an upper face of the head unit 16 smoothly and slidably. On an outer side of the cam member 21, a cam gear 21A is formed in a quarter of a circle, extending from the back side edge to the front side of the cam member 21. The cam gear 21A can be normally and reversely rotated and driven by a head motor 24 and a first gear train 25 provided inside the side wall 4. The head motor 24 is placed outside the back side end portion of the side wall 4, and constituted of a stepping motor and the like. As shown in FIG. 4, when the ribbon cassette 8 is to be inserted and removed, the head motor 24 is driven and rotated reversely to turn the cam members 21, 22 backward to a horizontal position so that the cam members 21, 22 are separated from the head unit 16. Further, the head unit 16 is rotated upward by the torsion spring 18 so that the head unit 16 is to be positioned above the ribbon cassette 8. When the paper 10 is to be printed, the head motor 24 is driven and rotated normally as described later, thereby turning the head unit 16 downward in accordance with a position of the paper 10 in the feeding motion (see FIGS. 13 to 18).

Figure 5:
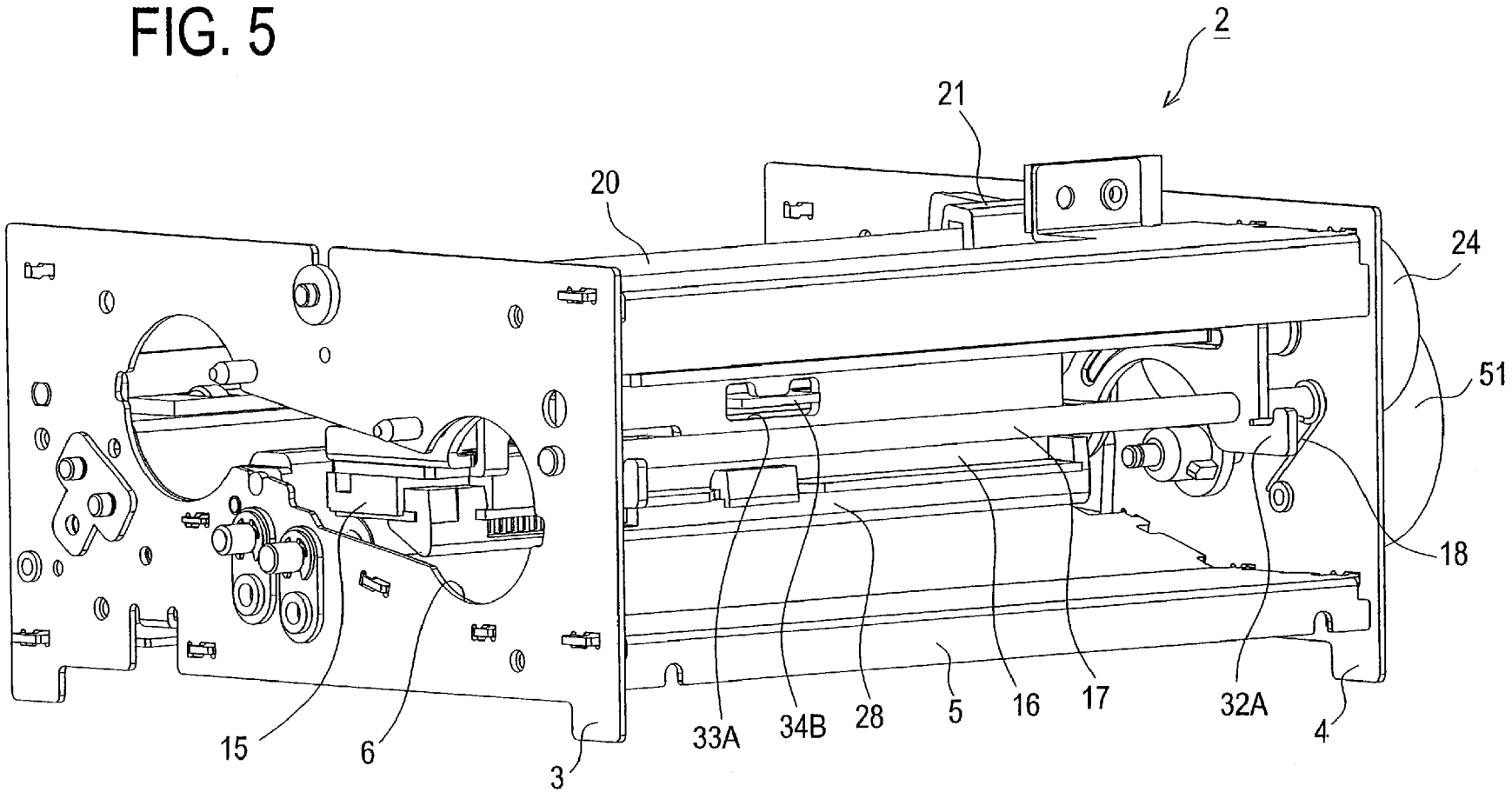
FIG. 5 is a perspective view of a main body of the printer seen from a back side.
Figure 6:
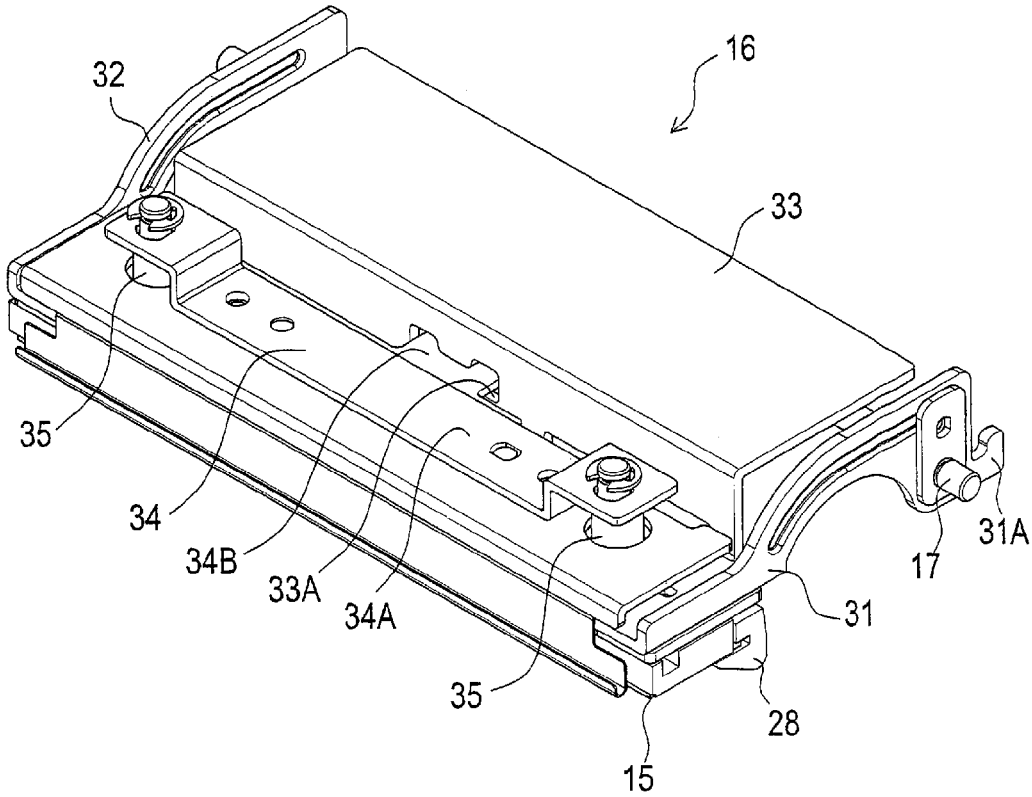
FIG. 6 is a perspective view of a head unit seen from above.
Figure 7:
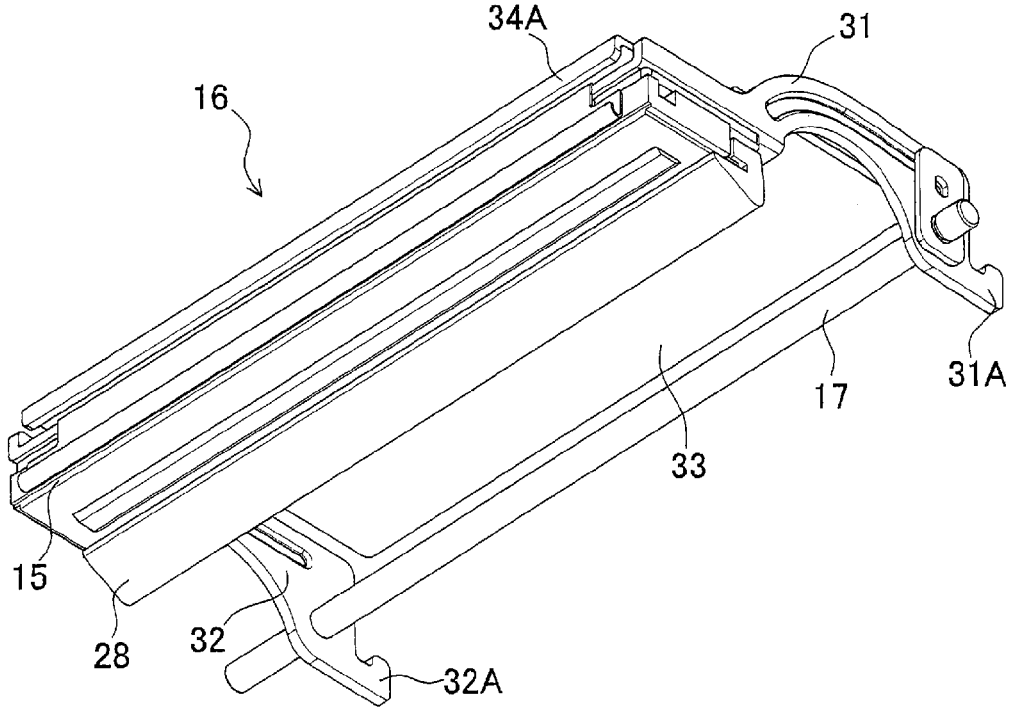
FIG. 7 is a perspective view of the head unit seen from below.
Figure 8:
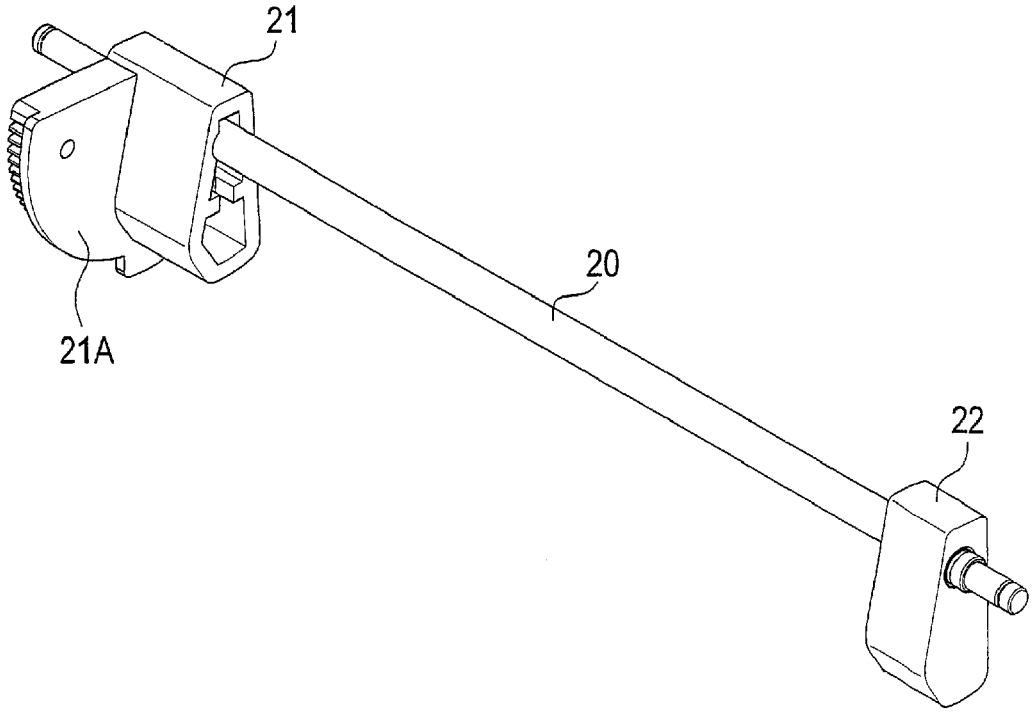
FIG. 8 is a perspective view showing a schematic structure of a pair of cam members.
Figure 9:
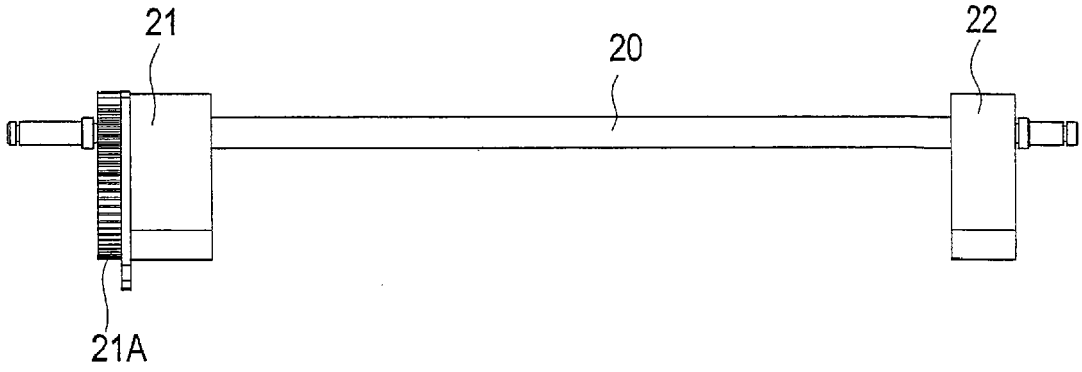
FIG. 9 is a front view showing the schematic structure of the pair of cam members.
Figure 10:
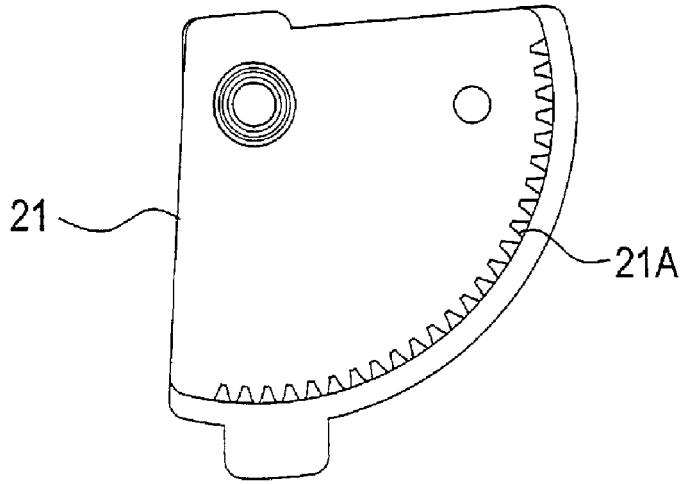
FIG. 10 is a left side view of FIG. 9.
Figure 11:
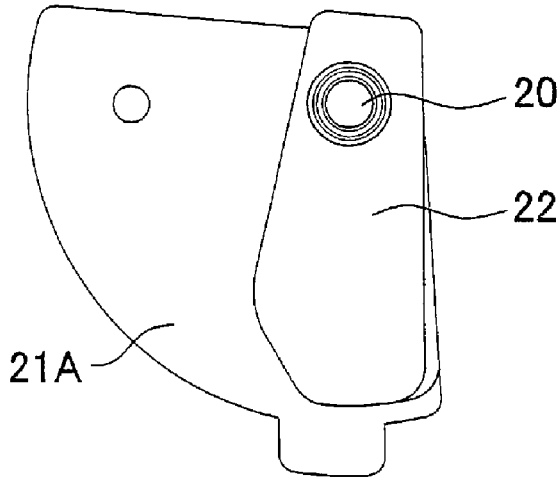
FIG. 11 is a right side view of FIG. 9.

As shown in FIGS. 4 to 6, a ribbon guide member 28 made of resin is provided along a lower back end portion of the head unit 16 on the side opposite to the thermal head 15. The ribbon guide member 28 is of a triangle shape in cross section protruding downward below the thermal head 15. The ribbon guide member 28 is formed as long as the thermal head 15, and inserted into an opening part 46 of the ribbon cassette 8 (see FIGS. 15 to 17). A top of the thermal head 15 is fixed to a front undersurface of a top plate 33 shaped like a crank in side view, laterally provided between the side walls 31, 32 of the head unit 16. A spring fixing board 34 is attached to the top of the thermal head 15, interposing the top plate 33 therebetween. Head springs 35, 35 are attached to the head unit 16 to keep a predetermined space between the spring fixing board 34 and the top plate 33. The head springs 35, 35 have stronger forces than the torsion spring 18. A cam plate 34A is on the center of the spring fixing board 34, which is recessed lower than both ends of the spring fixing board 34. The cam plate 34A is provided extending between the side walls 31, 32 of the head unit 16 so that both ends of the cam plate 34A are positioned close to the side walls 31, 32 respectively. The top surfaces of the ends of the cam plate 34A are brought into contact with the cam members 21, 22. A supporting part 34B, extending backward from a center of the spring fixing board 34, is fitted in an engagement hole 33A formed in the top plate 33. This allows the spring fixing board 34 and the cam plate 34A to slide vertically. Noted that the head springs 35, 35 are configured to press the thermal head 15 against the platen roller 37 by the predetermined force in printing.

As shown in FIGS. 1 and 4, the ribbon cassette 8 in a substantially rectangular shape is integrally composed of a ribbon storage part 41 of a substantially cylindrical shape, and a ribbon take-up part 42 of a substantially cylindrical shape, provided in parallel with the ribbon storage part 41, and a pair of connecting parts 43, 44 connecting the ribbon storage part 41 and the ribbon take-up part 42 together. In the center of the ribbon cassette 8, there is provided a feeding path of an ink ribbon 45, which is as wide as the thermal head 15. The ribbon cassette 8 also has an opening part 46 through which the long thermal head 15 and the long ribbon guide member 28 are inserted in the ribbon cassette 8 from above. The ribbon storage part 41 stores rotatably a ribbon spool 48 on which the ink ribbon 45 is wound so that its surface to be printed becomes outside. The ribbon take-up part 42 houses rotatably a ribbon take-up spool 49 to which an end of the ink ribbon 45 is fixed and which takes up the ink ribbon 45. A paper feeding motor 51 composed of a stepping motor and the like is driven and rotated normally and reversely, so that the ribbon spool 48 and the ribbon take-up spool 49 are normally and reversely rotated through a second gear train 52 in synchronization with the feeding motion of the paper 10. Accordingly, the ink ribbon 45 can be fed in forward and backward feeding directions.

The ribbon cassette 8 is placed so that the connecting parts 43, 44 are close to the platen roller 37. Also, the ribbon cassette 8 is installed at a downward and rightward inclination in the main body structure 2 as shown in FIG. 4 so that an ink ribbon delivery port of the ribbon storage part 41, or equivalently, an end part of the opening part 46 on the ribbon storage part 41 side is positioned lower than an upper end part of the platen roller 37 in a vertical direction. Accordingly, the ink ribbon 45 over the opening part 46 of the ribbon cassette 8 installed in the main body structure 2 is arranged to be approximately parallel to a plane joining the thermal head 15 and a lower end of the ribbon guide member 28, as shown in FIG. 4.

As shown in FIG. 4, the main body structure 2 has a paper supplying roller 55 above a front edge of the paper tray 11. The paper supplying roller 55 is rotated, pressing a front end of the paper 10 stored in the paper tray 11, and feeds the paper 10 one by one. On a downstream side of the paper supplying roller 55 in the forward feeding direction of the paper 10, in the proximity of the platen roller 37, there are provided a paper feeding roller 56 which is rotated to feed the paper 10 to a print start position, and a pinch roller 57 which is rotated in association with the rotation of the paper feeding roller 56 against the pinch roller 57. Furthermore, between the paper feeding roller 56 and the platen roller 37, a front-and-rear-end detection sensor 58 to detect a front end 10A and a rear end 10B of the paper 10 fed with the paper feeding roller 56.

It is noted that a photo sensor, a mechanical switch and the like are used as the front-and-rear-end detection sensor 58.

Furthermore, a guide piece 59 is swingably provided above the paper supplying roller 55 to guide the printed paper in a backward direction. A discharging roller 61 which is rotated to feed the paper 10 fed along the guide piece 59, and a pinch roller 62 which is rotated in association with the rotation of the discharging roller 61 pressed against the pinch roller 62 are arranged diagonally above the paper supplying roller 55 in the backward direction.

When the paper feeding motor 51 rotates and drives in the predetermined direction, the paper supplying roller 55 and the paper feeding roller 56 are rotated through the second gear train 52 to feed the paper 10 to the print start position. When the paper feeding motor 51 rotates and drives in the reverse direction of the predetermined direction, the platen roller 37, the paper feeding roller 56 and the discharging roller 61 are rotated with the second gear train 52 to move the paper 10 in the backward direction (the leftward direction in FIG. 4). Finally, the paper 10 is discharged outside when the current printing is the last printing.

Next, a control system of the printer 1 configured as above will be explained with reference to FIG. 12.

Figure 12:
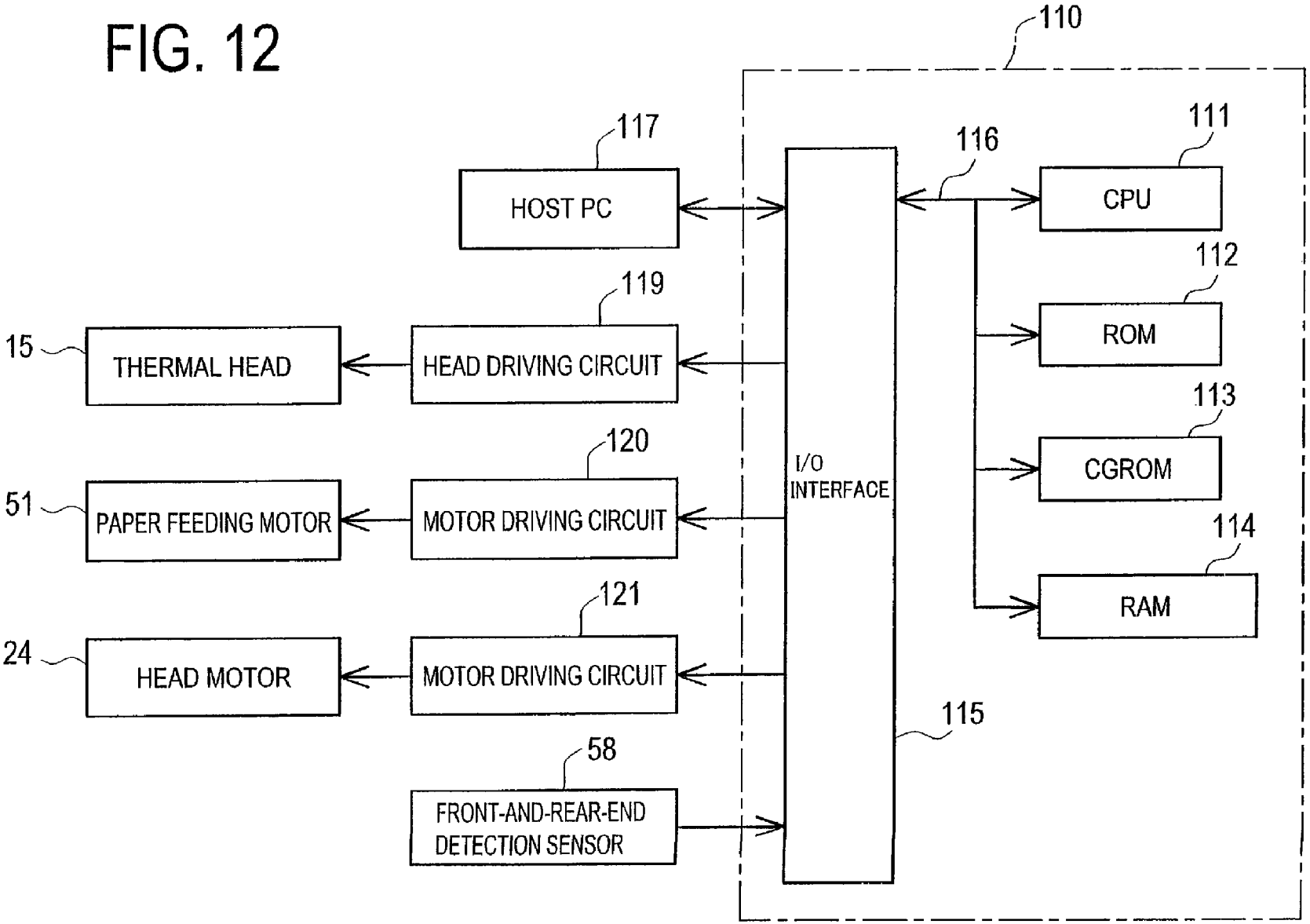
FIG. 12 is a block diagram of a control unit of the printer.

As shown in FIG. 12, the control system of the printer 1 includes a control circuit 110 as a core. The control circuit 110 comprises a CPU 111, a ROM 112, a CGROM 113, a RAM 114 and an input/output (I/O) interface 115, which are connected to each other through a bus line 116.

Herein, the ROM 112 stores various programs, for instance, a program necessary for controlling the printer 1, such as a program for feeding the paper 10 to the print start position, and for performing rotating and driving control of the head motor 24 to turn the head unit 16 downward, which will be mentioned in detail later.

The CPU 111 performs various operations based on the programs stored in the ROM 112.

The CGROM 113 stores dot pattern data corresponding to each of characters. The dot pattern data is read from the CGROM 113 as required, and then dot pattern is printed on the paper 10 based on the dot pattern data, with the thermal head 15.

The RAM 114 works as a temporary storage to store the result of the operations performed in the CPU 111. The RAM 114 is provided with a text memory, an image buffer, a print buffer and other memory areas.

The I/O interface 115 is connected to an external control unit 117 (hereinafter, referred to as a "host PC"), a head driving circuit 119 for driving the thermal head 15, a motor driving circuit 120 for driving the paper feeding motor 51 to feed the paper 10, a motor driving circuit 121 for driving the head motor 24 to turn the head unit 16 upward and downward so that the thermal head 15 is pressed and released, and the front-and-rear-end detection sensor 58 for detecting the front end 10A and the rear end 10B of the paper 10 fed with the paper feeding roller 56.

With reference to FIGS. 13 to 18, the following will describe operations of the printer 1 configured as above, such as the rotating and driving control of the paper feeding motor 51 to feed the paper 10 to the print start position, the rotating and driving control of the head motor 24 to turn the head unit 16 downward, and printing operation.

Figure 13:
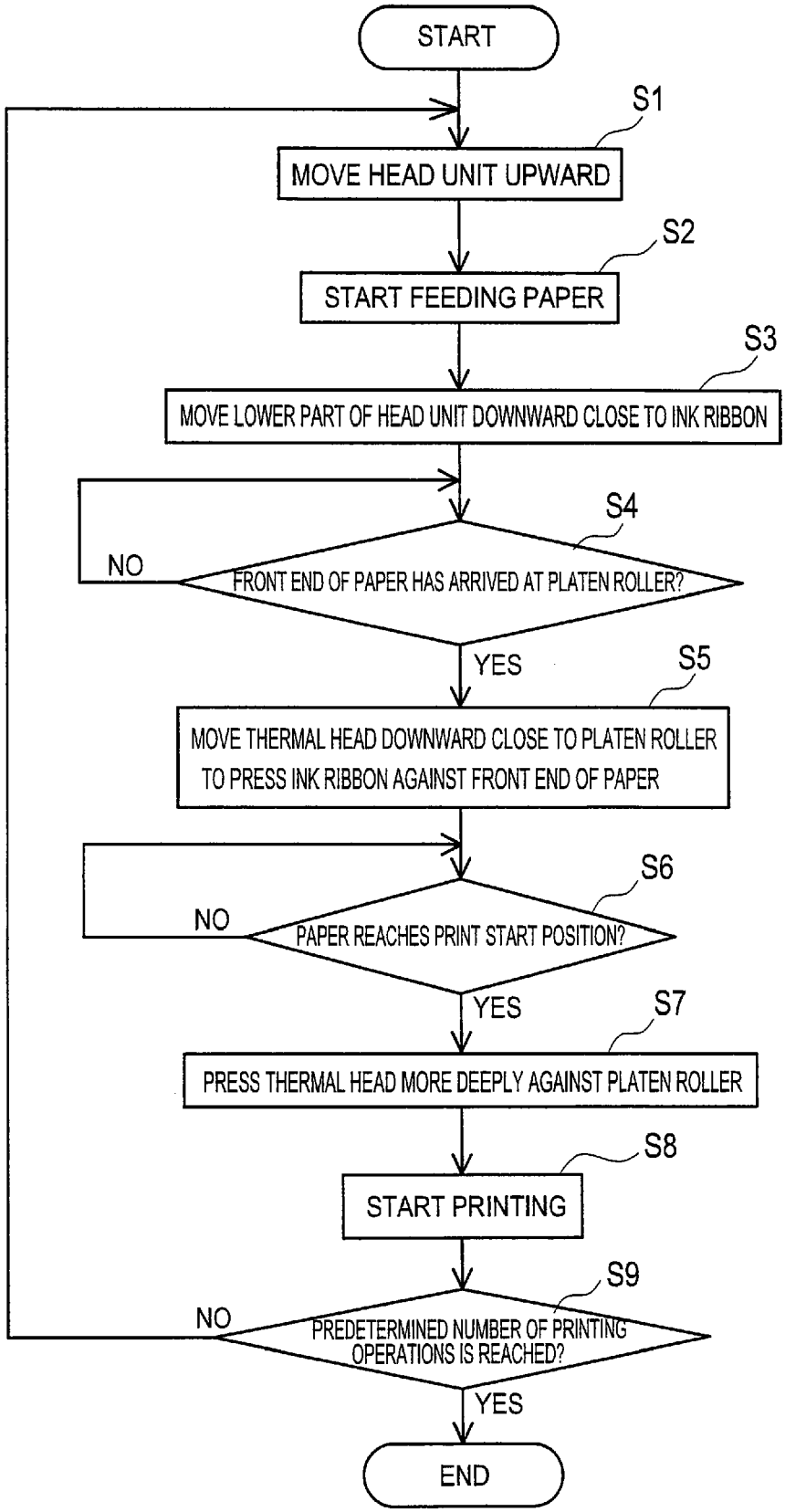
FIG. 13 is a flowchart of a drive and control process of the head unit.

Firstly, as shown in FIG. 13, at Step (hereinafter, "S") 1, the CPU 111 rotates and drives the head motor 24 reversely, and turns the cam gear 21A about 90° counterclockwise in side view through the first gear train 25 to turn the cam members 21, 22 to a substantially horizontal position, and separates them from the cam plate 34A. As a result of this, the head unit 16 is turned clockwise about the turning shaft 17 by the force of the torsion spring 18, and moves the front part of the head unit 16 upward. Thus, each lower part of the thermal head 15 and the ribbon guide member 28 is moved to the position above the ribbon cassette 8. In this state, the ribbon cassette 8 can be removed from or set in the main body structure (a first state).

At S2, when the host PC 117 outputs the print start command, the CPU 111 rotates and drives the paper feeding motor 51 in the predetermined direction, so that the paper supplying roller 55 and the paper feeding roller 56 are rotated with the second gear train 52, and then the paper 10 starts being fed.

At S3, when the front-and-rear-end detection sensor 58 detects the front end 10A of the paper 10, the CPU 111 calculates the time required for the paper 10 to arrive at the platen roller 37, from a rotation speed of the paper feeding motor 51. The CPU 111 rotates and drives the head motor 24 in the normal direction for the predetermined time (the predetermined number of steps) within the calculated time. After that, the CPU 111 turns the cam gear 21A a turning angle of about 25° to 35° clockwise with the first gear train 25, brings the cam members 21, 22 into contact with the top face of the cam plate 34A, and slides the cam members 21, 22 over the cam plate 34A. With this sliding movement of the cam members 21, 22, the cam plate 34A and the spring fixing board 34 are pressed downward, and the front side part of the top plate 33 is pressed downward by the head spring 35. Accordingly, the head unit 16 is turned by the predetermined distance counterclockwise shown in FIG. 14 against the force of the torsion spring 18. Further, the lower faces of the thermal head 15 and the ribbon guide member 28 are moved downward to the vicinity of the ink ribbon 45 in the opening part 46 (a second state).

Figure 14:
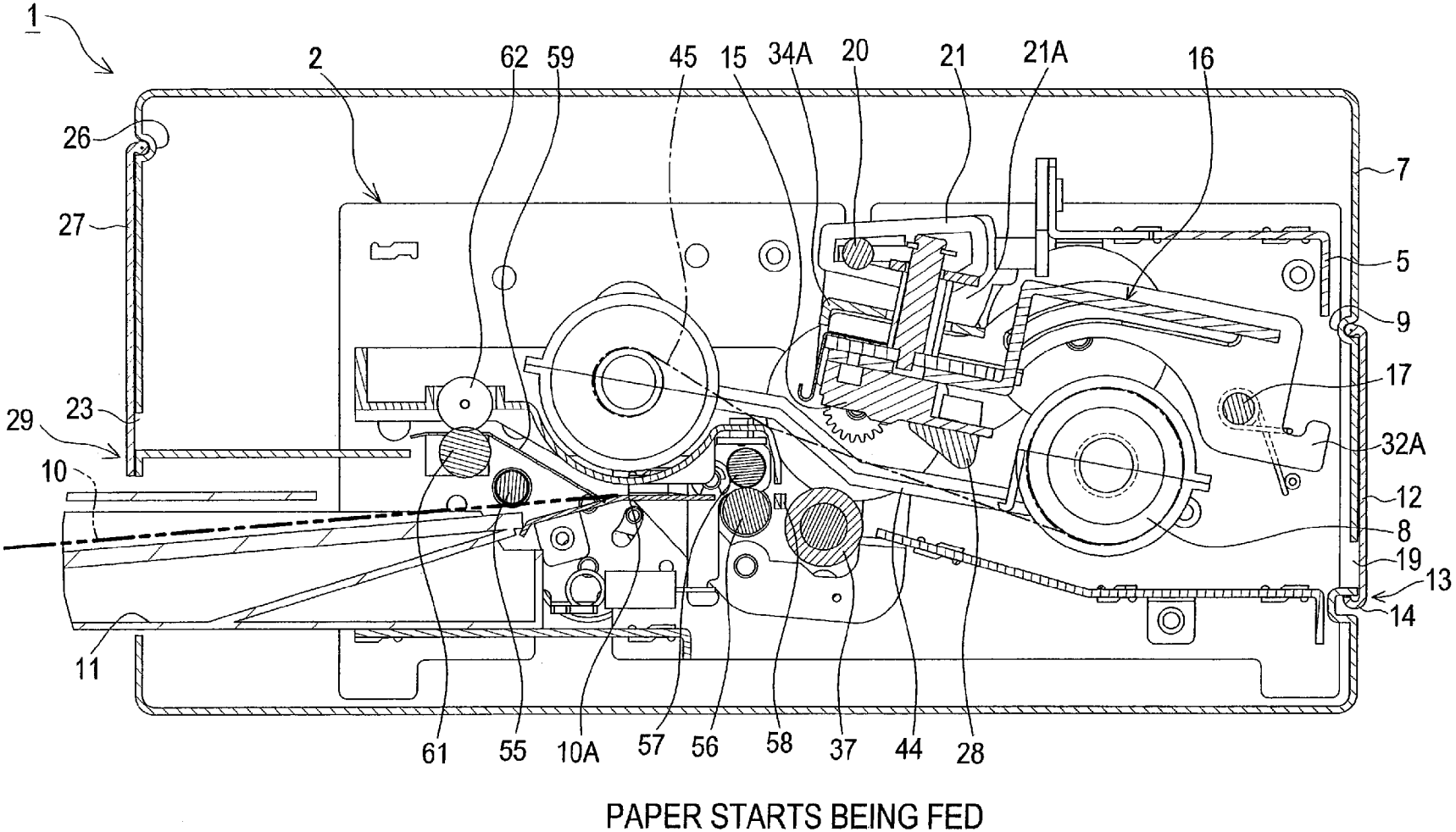
FIG. 14 is a sectional side view of the printer at the start of feeding paper.

For instance, as shown in FIG. 14, when the front-and-rear-end detection sensor 58 detects the front end 10A of the paper 10, the CPU 111 calculates the time required to move the paper 10 to the platen roller 37 from the rotation speed of the paper feeding motor 51. The CPU 111 rotates and drives the head motor 24 in the normal direction for the predetermined time (the predetermined number of steps) within the calculated time. After that, the CPU 111 turns the cam gear 21A the turning angle of about 30° clockwise with the first gear train 25, brings the cam members 21, 22 into contact with the top face of the cam plate 34A, and slides the cam members 21, 22 over the cam plate 34A. With this sliding movement of the cam members 21, 22, the head unit 16 can be turned counterclockwise in FIG. 14, as mentioned above.

Figure 15:
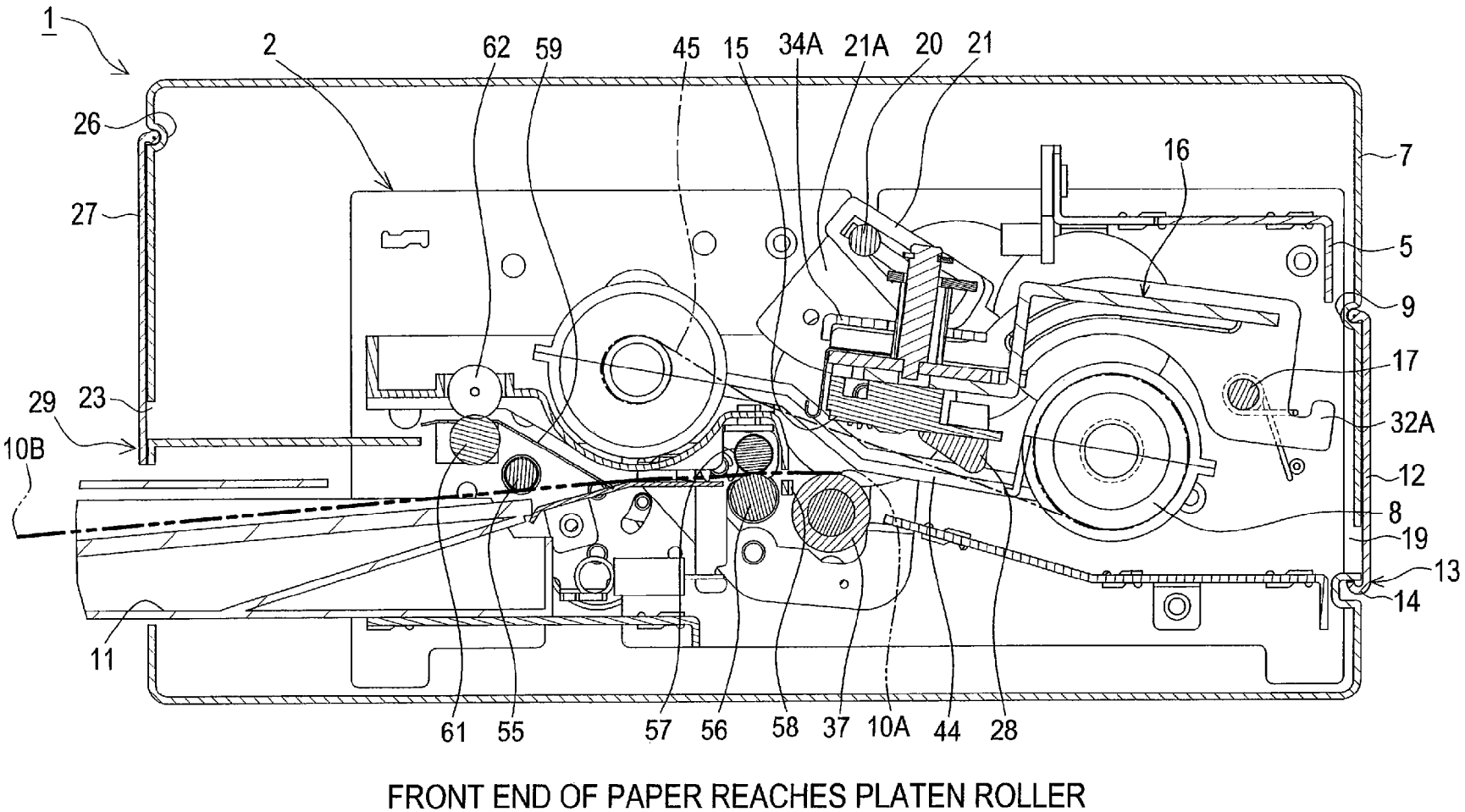
FIG. 15 is a sectional side view of the printer showing a state that a front end of the paper to be fed to a print start position reaches a platen roller.

As a result of the above operations, as shown in FIG. 15, when the paper 10 is fed in association with the rotation of the paper supplying roller 55 and the paper feeding roller 56, and the front end 10A of the paper 10 reaches the platen roller 37, the lower ends of the thermal head 15 and the ribbon guide member 28 are moved downward to the vicinity of the ink ribbon 45 of the ribbon cassette 8.

Next at S4, the CPU 111 waits the time calculated at S3, required for the arrival of the paper 10 at the platen roller 37, or equivalently, waits until the front end 10A of the paper 10 has passed over the upper part of the platen roller 37 (S4:NO).

When the front end 10A of the paper 10 has passed over the upper part of the platen roller 37 (S4:YES), at S5, the CPU 111 calculates from the rotation speed of the paper feeding motor 51, the time required for the arrival of the paper 10 in the proximity of the ink ribbon 45 (for instance, at a position 0.5 mm to 2.0 mm away from the ink ribbon 45) after passing over the upper part of the platen roller 37. The CPU 111 rotates and drives the head motor 24 within the normal direction for the predetermined time (the predetermined number of steps) within the calculated time. After that, the CPU 111 turns the cam gear 21A the turning angle of about 45° to 65° clockwise through the first gear train 25, and slides the cam members 21, 22 over the top face of the cam plate 34A. As the cam members 21, 22 slide, the cam plate 34A and the spring fixing board 34 are pressed downward, and synchronously, the front side part of the top plate 33 is further pressed downward by the head spring 35. Accordingly, the head unit 16 is turned counterclockwise in FIG. 15 the predetermined length, and the lower ends of the thermal head 15 and the ribbon guide member 28 are moved downward. In association with the movements of the thermal head 15 and the ribbon guide member 28, the ink ribbon 45 is pressed downward in obliquely right direction in side view. The front end 10A of the paper 10, brought into contact with the ink ribbon 45, is set in a position in which the ink ribbon 45 can press the paper 10 downward (a third state).

Figure 16:
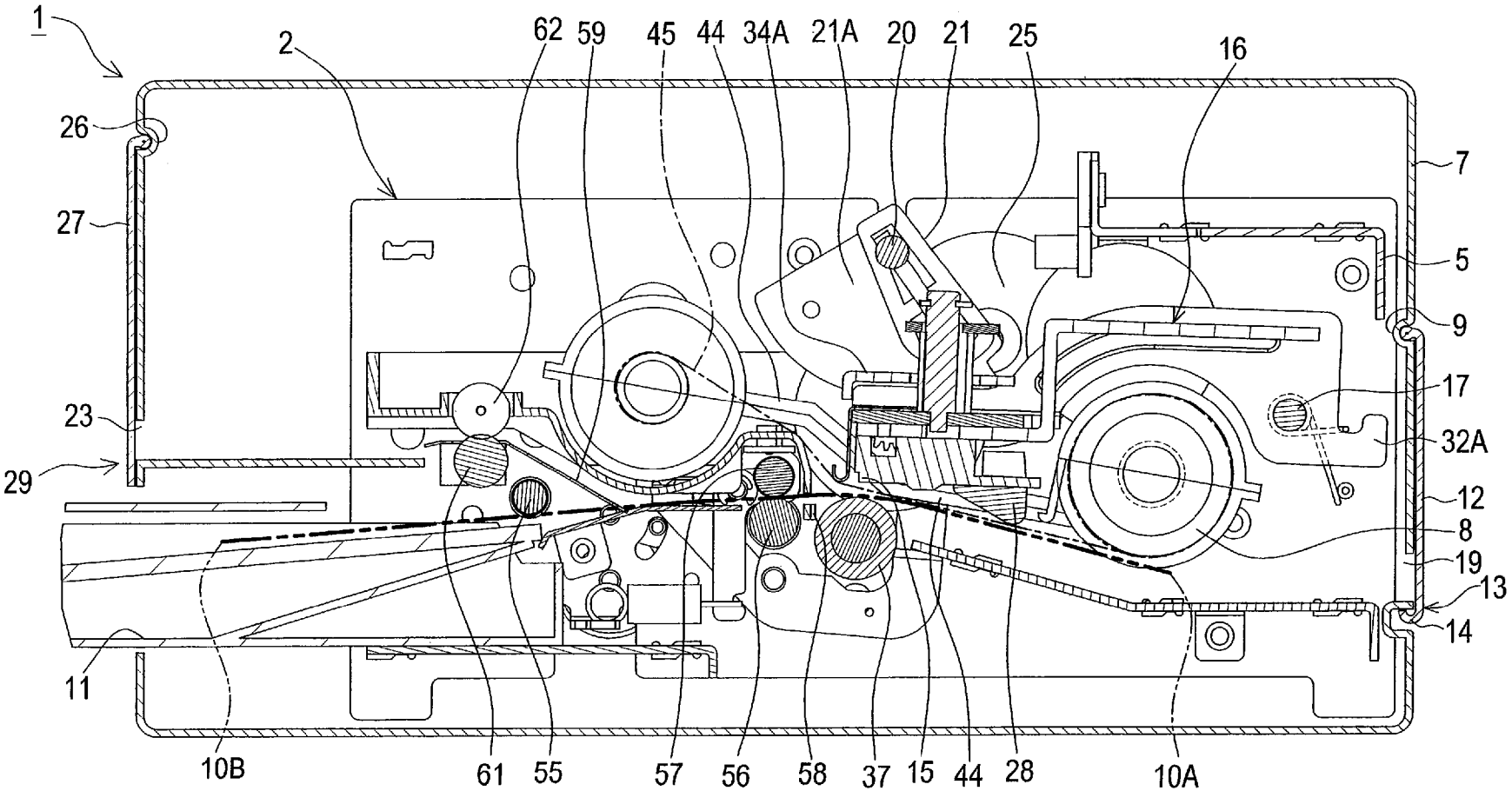
FIG. 16 is a sectional side view of the printer showing a state that the front end of the paper to be fed to the print start position reaches an ink ribbon.

For instance, as shown in FIG. 16, the CPU 111 rotates and drives the head motor 24 in the normal direction for the predetermined time (the predetermined number of steps), in order to turn the cam gear 21A the turning angle of about 55° clockwise with the first gear train 25, and further slides the cam members 21, 22 over the top face of the cam plate 34A. With this sliding movement, as mentioned above, the head unit 16 is turned counterclockwise more deeply. Accordingly, the front end 10A of the paper 10 is moved horizontally over the platen roller 37, and brought into contact with the ink ribbon 45 pressed downward in obliquely right direction in side view, by the lower faces of the thermal head 15 and the ribbon guide member 28, which are moved down in association with the rotation of the head unit 16. Therefore, the front end 10A of the paper 10 is guided downward in obliquely right direction in side view along an underside of the ink ribbon 45 and to the position lower than the ink ribbon delivery port of the ribbon storage part 41.

At S6, from the rotation speed of the paper feeding motor 51, the CPU 111 calculates the time required from the detection of the front end 10A of the paper 10 by the front-and-rear-end detection sensor 58 at above-described S3 to the arrival of the paper 10 at the print start position. The CPU 111 waits until the calculated time elapses since the front-and-rear-end detection sensor 58 detects the front end 10A of the paper 10. In other words, the CPU 111 waits until the paper 10 is fed to the print start position by the rotation of the paper supplying roller 55 and the paper feeding roller 56 (S6:NO).

When the paper 10 has arrived at the print start position by the rotation of the paper supplying roller 55 and the paper feeding roller 56 (S6:YES), the process goes to S7. At S7, the CPU 111 stops the paper feeding motor 51. At the same time, the CPU 111 rotates and drives the head motor 24 in the normal direction for the predetermined time (the predetermined number of steps) to turn the cam gear 21A the turning angle of about 85° to 95° clockwise with the first gear train 25, and to slide the cam members 21, 22 over the cam plate 34A until the cam members 21, 22 are oriented vertically in side view. Accordingly, the cam plate 34A and the spring fixing board 34 are pressed downward more deeply, thereby pressing the front side part of the top plate 33 downward. As a result of this, the head unit 16 is turned downward a predetermined distance, while the thermal head 15 moves down to be set in the position in which the thermal head 15 presses the ink ribbon 45 and the paper 10 against the platen roller 37 (a fourth state). Also, the lower face of the ribbon guide member 28 moves down to be set in the position in which the ribbon guide member 28 further presses against the ink ribbon 45 in obliquely right direction in side view (a fourth state).

Figure 17:
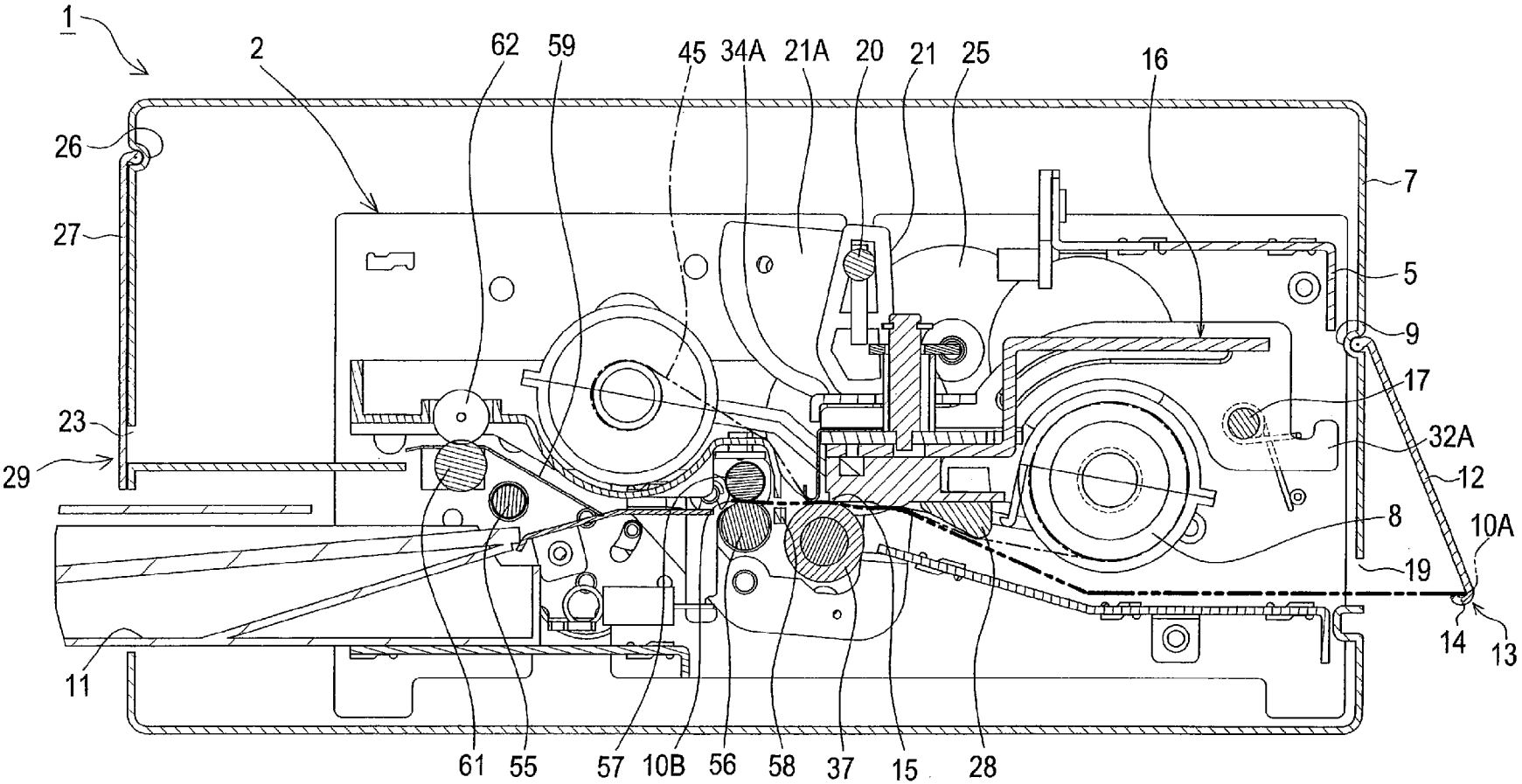
FIG. 17 is a sectional side view of the printer showing a state that the paper reaches the print start position.

For instance, as shown in FIG. 17, the paper 10 is fed along the underside of the ink ribbon 45 by the rotation of the paper supplying roller 55 and the paper feeding roller 56, and to the print start position without being jammed at the ribbon delivery port of the ribbon storage part 41. After that, the paper feeding motor 51 is stopped, and the pair of the paper feeding roller 56 and the pinch roller 57 tightly holds a predetermined point of the front end 10A of the paper 10 to stop feeding motion of the paper 10. Also, the cam gear 21A is turned about 95°, so that the cam members 21, 22 become vertical in side view, and thereby the thermal head 15 presses the ink ribbon 45 and the paper 10 against the platen roller 37, brought to a position opposite to the print start position of the paper 10.

In this state, the front end 10A of the paper 10 is projected from the housing 7 through the first paper projection port 19. The front end 10A of the paper 10 is projected rightward in the figures through the first paper projection port 19, pressing against the first cover 12 which swings about the first engagement portion 9 provided in the housing 7. Even when the front end 10A of the paper 10 is projected the maximum length, the first cover 12 still covers the paper 10 as the printing medium to be printed. This makes it possible to prevent dust from above adhering to the paper 10, thereby avoiding the entry of dust to or near the printing device such as the thermal head 15, the ink ribbon 45 and the platen roller 37, which avoids the deterioration in the print quality of the paper 10. Furthermore, a free end 13 of the first cover 12 is provided with a hook-shaped second engagement portion 14 to hold front end 10A of the paper 10. When the first cover 12 is pressed by the front end 10A of the paper 10, the front end 10A of the paper 10 is hooked on the second engagement portion 14. Thus, the first cover 12 can surely swing about the first engagement portion 9 of the housing 7, covering the paper 10.

Figure 19:
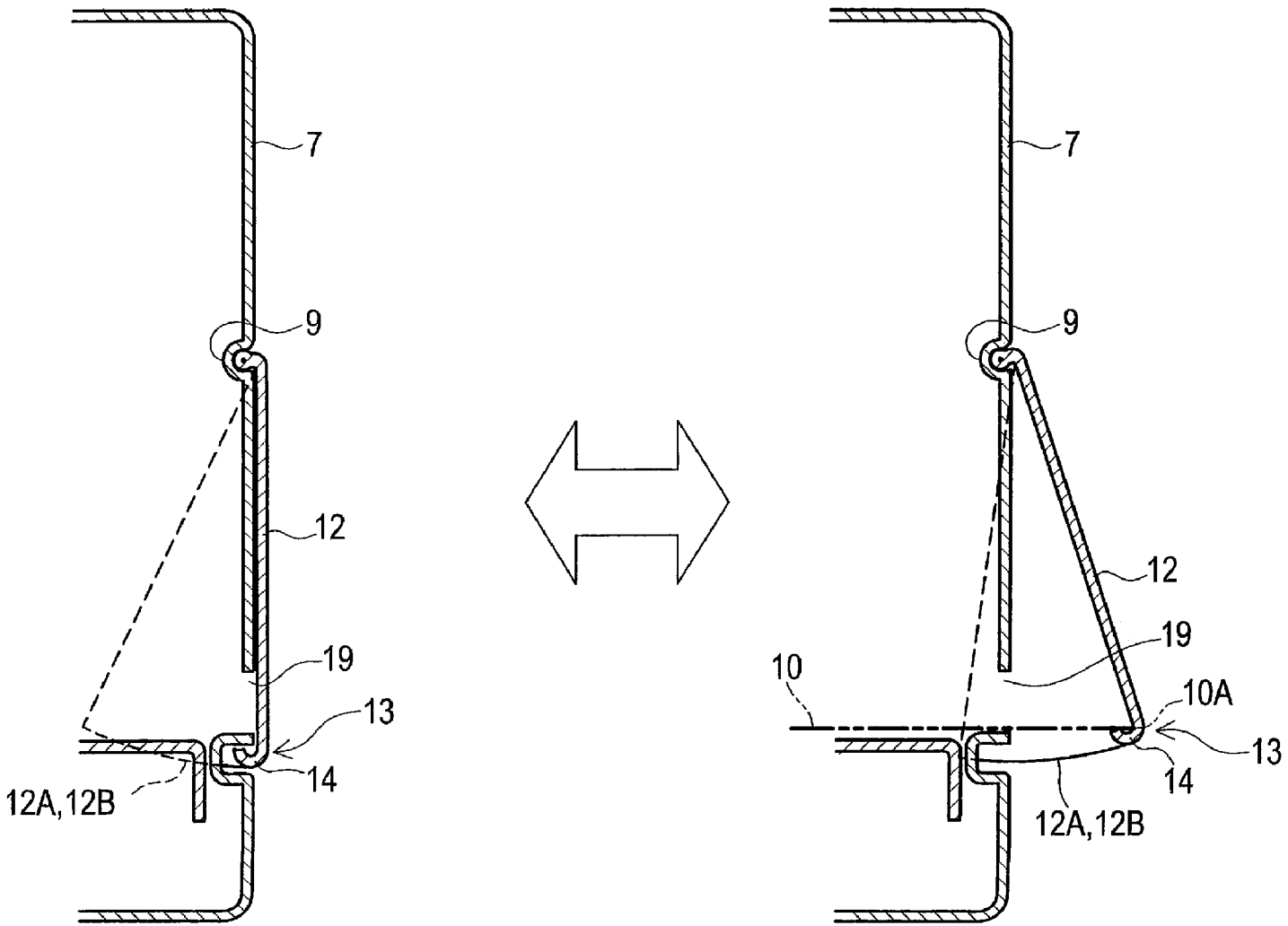
FIG. 19 is a partial view of the printer that side covers are provided in a first cover.

It is noted that the first cover 12 may be provided with side covers 12A, 12B along both sides thereof, as shown in FIG. 19 to prevent the entry of dust from every direction.

Next at S8, the CPU 111 rotates and drives the paper feeding motor 51 reversely to turn the platen roller 37, the paper feeding roller 56, and the discharging roller 61, and thereby the paper 10 is fed backward. At the same time, the CPU 111 starts printing print data stored in the print buffer of the RAM 114 with the thermal head 15. The CPU 111 continues to move the paper 10 after printing is over. When the front-and-rear-end detection sensor 58 detects the front end 10A of the paper 10, the CPU 111 temporarily stops the feeding motion of the paper 10 with the front end 10A held tightly between the paper feeding roller 56 and the pinch roller 57.

Figure 18:
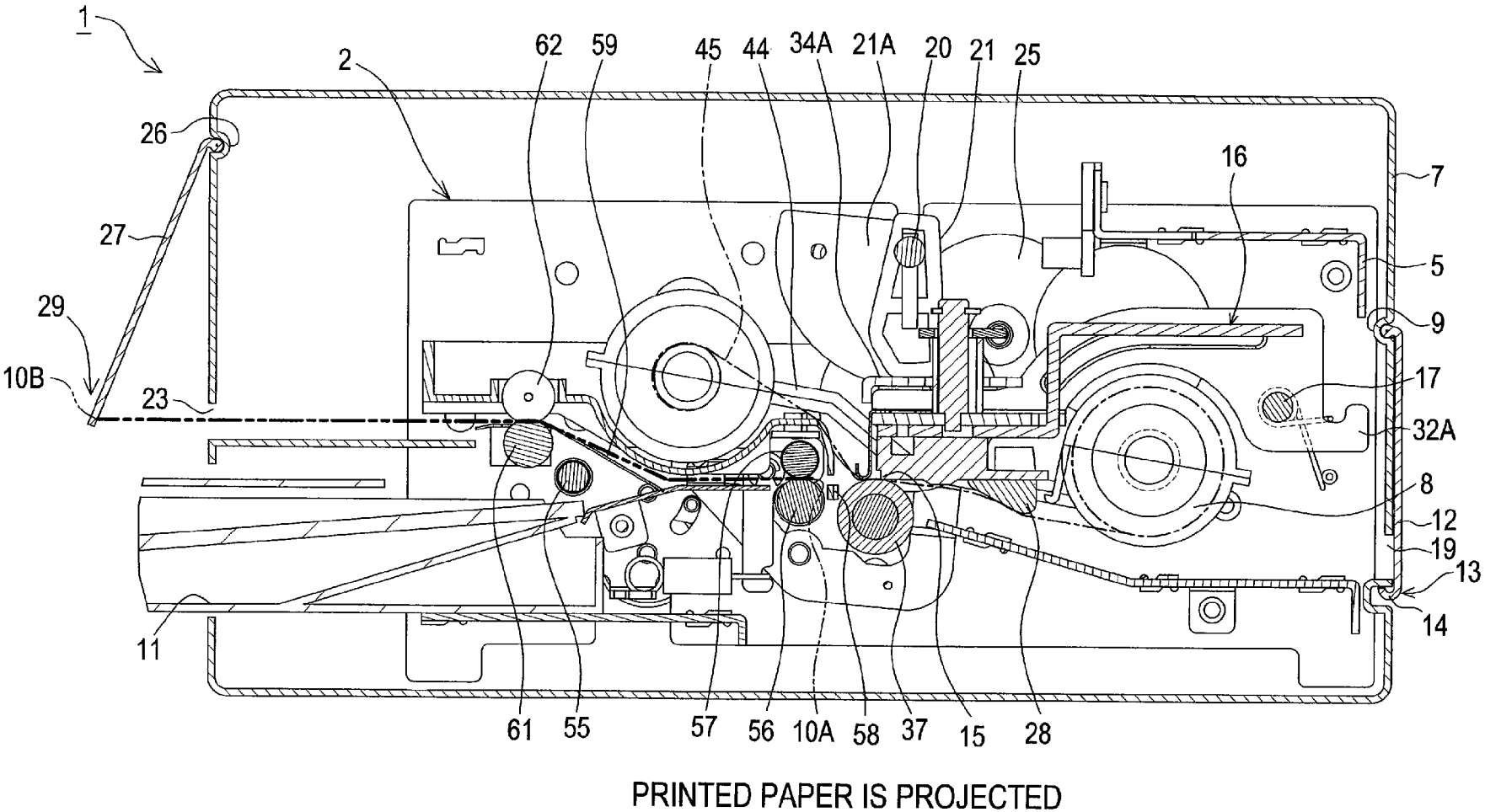
FIG. 18 is a sectional side view of the printer showing a state that the paper is printed and projected.

For instance, as shown in FIG. 18, the paper 10 is fed backward from the print start position by the rotation of the platen roller 37 and the paper feeding roller 56, and is simultaneously printed with the thermal head 15. After passing under the ribbon take-up part 42 of the ribbon cassette 8, the rear end 10B of the paper 10 is guided obliquely upward by contact with the guide piece 59, and projected from the housing 7 through the second paper projection port 23 with the discharging roller 61 and the pinch roller 57. When the front-and-rear-end detection sensor 58 detects the front end 10A of the paper 10, the CPU 111 temporarily stops the feeding motion of the paper 10 with the front end 10A held tightly between the paper feeding roller 56 and the pinch roller 57.

In this operation, the front end 10A of the paper 10 is moved to the inside of the housing 7. Responding to the movement of the front end 10A of the paper 10, the first cover 12 is returned by its own weight to a position to close the first paper projection port 19.

The rear end 10B of the paper 10, which is projected from the housing 7 through the second paper projection port 23 as mentioned above, is projected through the second paper projection port 23 leftward in the figures, pressing against the second cover 27 which swings about the third engagement portion 26 provided in the housing 7. When the CPU 111 temporarily stops the feeding motion of the paper 10 by the detection of the front end 10A of the paper 10 by the front-and-rear-end detection sensor 58, the second cover 27 still covers the paper 10 as the printing medium to be printed. This makes it possible to prevent dust from above adhering to the paper 10, thereby avoiding the entry of dust to or near the printing device such as the thermal head 15, the ink ribbon 45 and the platen roller 37, which avoids the deterioration in the print quality of the paper 10.

Figure 20:
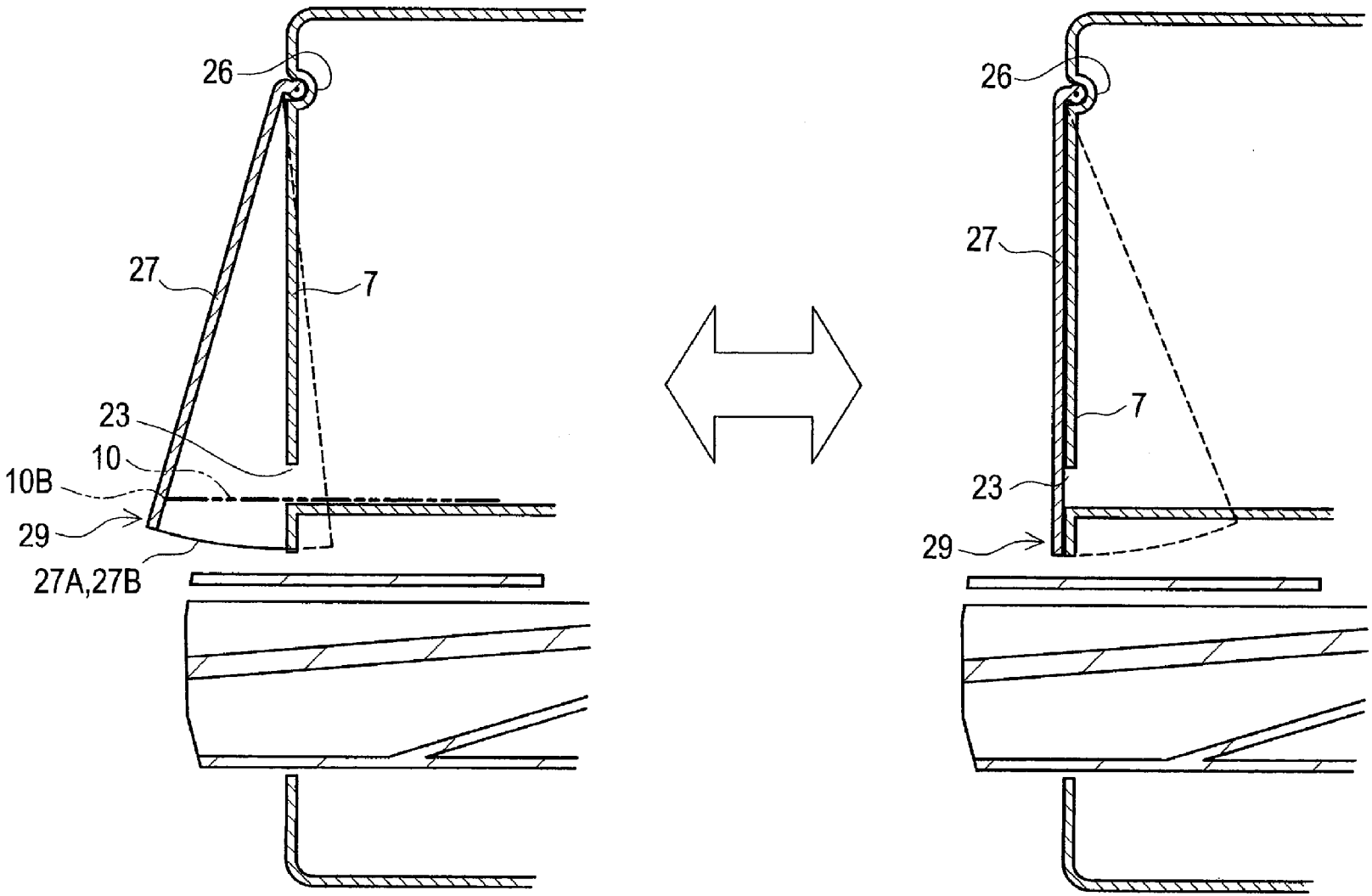
FIG. 20 is a partial view of the printer that side covers are provided in a second cover.

It is noted that the second cover 27 may be provided with the side covers 27A, 27B along both sides thereof as shown in FIG. 20 to prevent the entry of dust from every direction.

Figure 21:
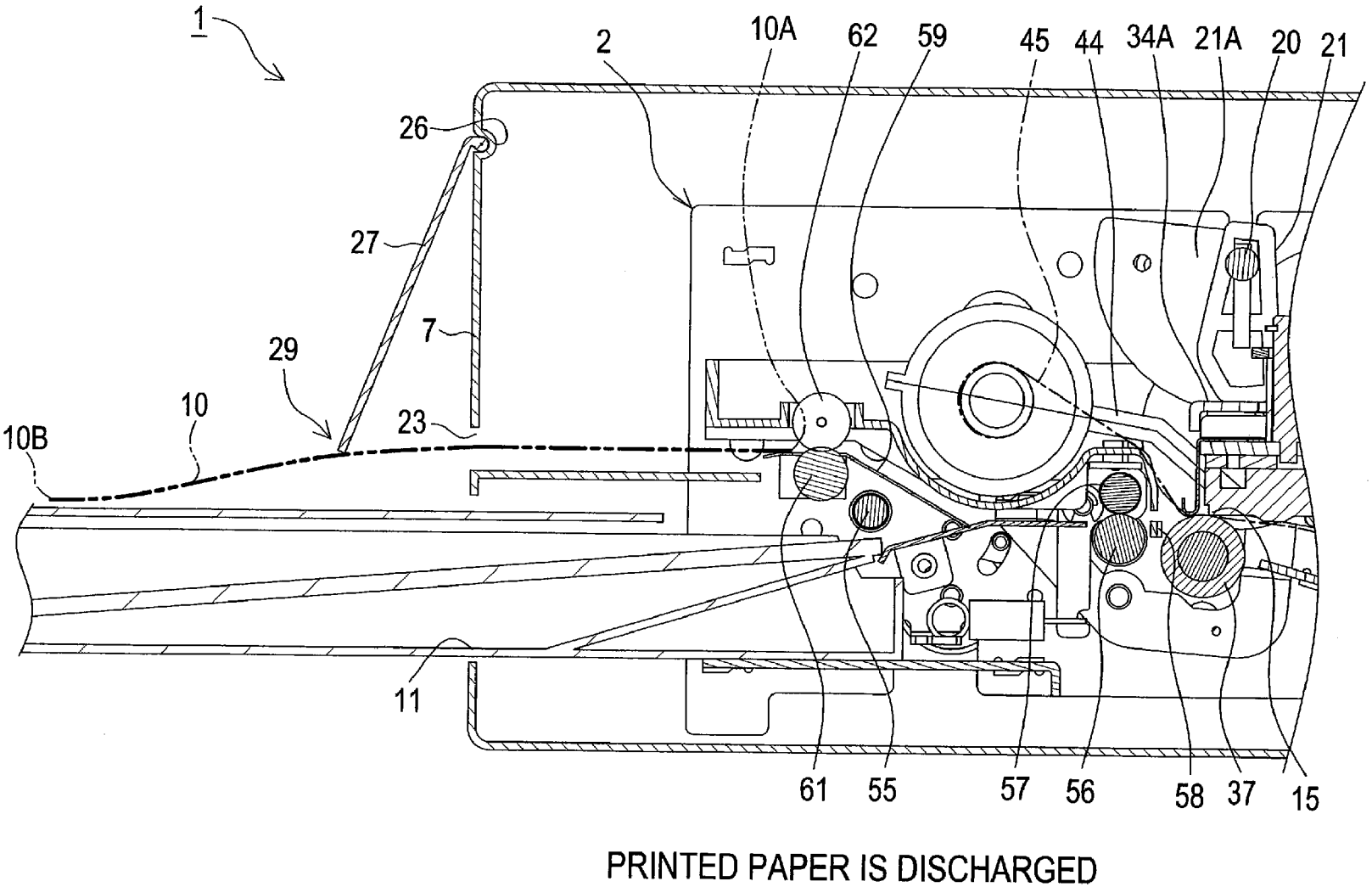
FIG. 21 is a partial view of the printer showing a state that the paper is discharged after printed.

Next at S9, the CPU 111 determines whether printing operations on the paper 10 has been performed a predetermined number. If the printing operations are performed less than the predetermined number (S9:NO), the process goes back to S1, and continues until the count of printing operations reaches the predetermined number. In this case, the rear end 10B of the paper 10 is moved to the inside of the housing 7. Responding to the movement of the rear end 10B of the paper 10, the second cover 27 is returned by its own weight to a position to close the second paper projection port 23. If the predetermined number of printing operations is reached (S9: YES), the paper 10 is discharged outside the housing 7 through the second paper projection port 23 with the discharging roller 61 and the pinch roller 62 (see FIG. 21).

Figure 22:
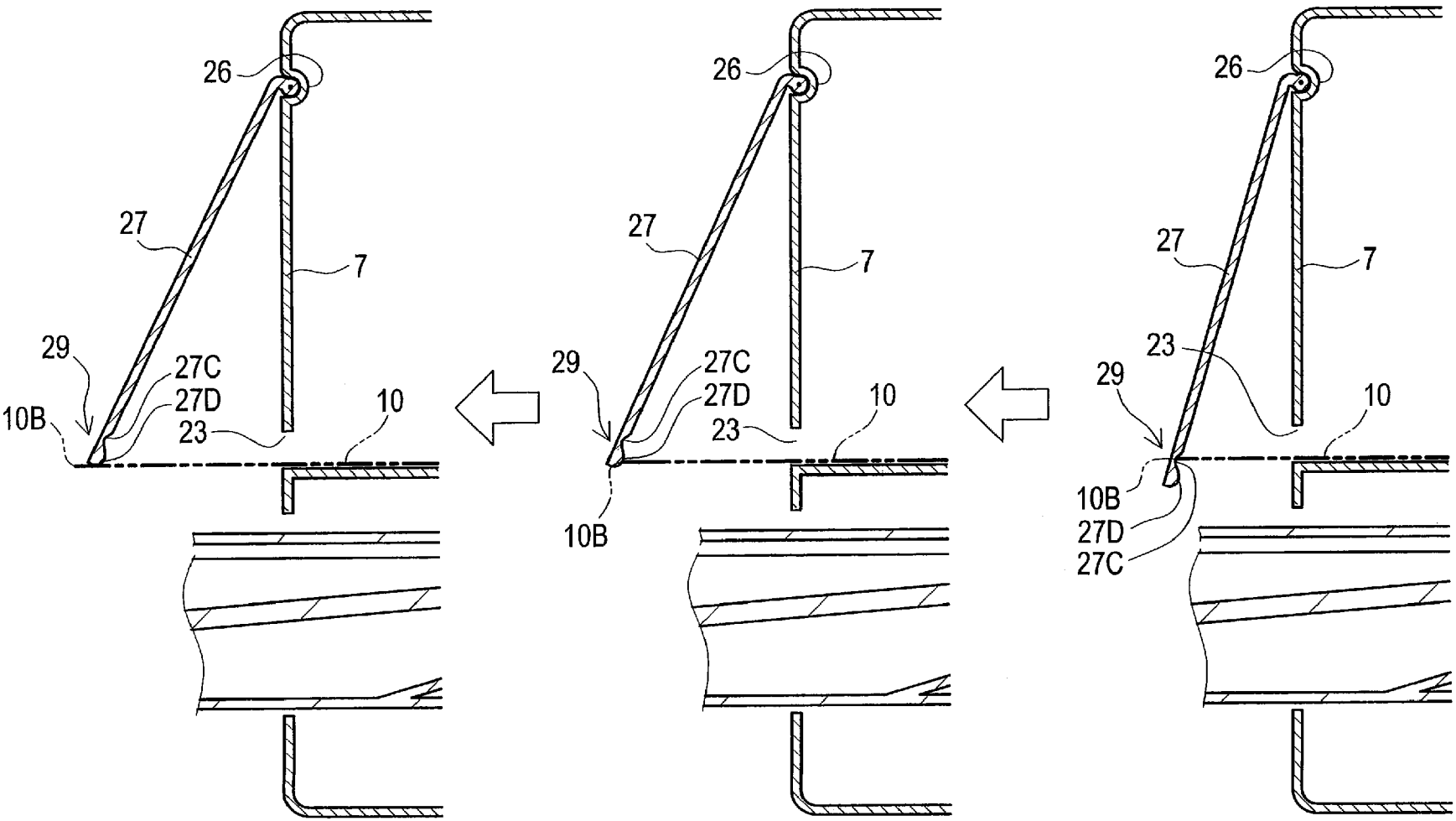
FIG. 22 is a partial view of the printer showing a state that a free end of the second cover is provided with a depression and a projection to surely support the paper, and the paper passes over the projection to be discharged.

It is noted that a depression 27C and a projection 27D may be provided in a free end 29 of the second cover 27, as shown in FIG. 22. As a result of this, even when the CPU 111 stops the feeding motion of the paper 10 by the detection of the front end 10A of the paper 10 by the front-and-rear-end detection sensor 58, the paper 10 can be surely supported by the depression 27C of the free end 29 of the second cover 27, and released along the projection 27D by the pressure against the second cover 27 to be projected.

As described in detail above, the printer 1 of the exemplary embodiment comprises the first cover 12 which swings about the first engagement portion 9 provided in the housing 7. The first cover 12 covers the first paper projection port 19 through which the paper 10 is projected, when the paper 10 as the printing medium is inside the housing 7. This can prevent the entry of dust through the first paper projection port 19 to the housing 7. Furthermore, the first cover 12 swings about the first engagement portion 9 by the pressure of the front end 10A of the paper 10 when projected through the first paper projection port 19 in the forward feeding motion by the feeding device such as the paper feeding motor 51, the second gear train 52, the paper supplying roller 55, the paper feeding roller 56, the pinch roller 57, the platen roller 37, the discharging roller 61 and the pinch roller 62. This makes it possible to prevent dust adhering to the paper 10, thereby avoiding the entry of dust to or near the printing device such as the thermal head 15, the ink ribbon 45 and the platen roller 37, which can improve the print quality of the paper 10 as the printing medium.

The printer 1 also comprises the second cover 27 which swings about the third engagement portion 26 provided in the housing 7. The second cover 27 covers the second paper projection port 23 through which the paper 10 is projected, when the paper 10 as the printing medium to be printed is inside the housing 7. This can prevent the entry of dust through the second paper projection port 23 to the housing 7. Furthermore, the second cover 27 swings about the third engagement portion 26 by the pressure of the rear end 10B of the paper 10 when projected through the second paper projection port 23 in the backward feeding motion by the feeding device such as the paper feeding motor 51, the second gear train 52, the paper supplying roller 55, the paper feeding roller 56, the pinch roller 57, the platen roller 37, the discharging roller 61 and the pinch roller 62. This makes it possible to prevent dust from adhering to the paper 10, thereby avoiding the entry of dust to or near the printing device such as the thermal head 15, the ink ribbon 45 and the platen roller 37, which can improve the print quality of the paper 10 as the printing medium.

Furthermore, the first cover 12 is returned by its own weight to the position to close the first paper projection port 19 in the backward feeding motion of the paper 10 by the feeding device such as the paper feeding motor 51, the second gear train 52, the paper supplying roller 55, the paper feeding roller 56, the pinch roller 57, the platen roller 37, the discharging roller 61 and the pinch roller 62. As a result of this, any additional part to close the first cover 12 is unnecessary, which can avoid an increase of the cost.

Also, the second cover 27 is returned by its own weight to the position to close the second paper projection port 23 in the forward feeding motion of the paper 10 by the feeding device such as the paper feeding motor 51, the second gear train 52, the paper supplying roller 55, the paper feeding roller 56, the pinch roller 57, the platen roller 37, the discharging roller 61 and the pinch roller 62. As a result of this, any additional part to close the second cover 27 is unnecessary, which can avoid an increase of the cost.

Furthermore, the second engagement portion 14 is provided in the free end 13 of the first cover 12 so that the second engagement portion 14 holds the front end 10A of the paper 10 when the first cover 12 swings about the first engagement portion 9 to cover the paper 10 by the pressure of the front end 10A of the paper 10. This can prevent the paper 10 from being bent downward. Also, the first cover 12 can certainly swing about the first engagement portion 9.

The printer 1 further comprises the detection device and a pair of the paper feeding roller 56 and the pinch roller 57. The detection device includes the front-and-rear-end detection sensor 58 and the control circuit 110 to detect the front end 10A of the paper 10 as the printing medium to be printed. The pair of the paper feeding roller 56 and the pinch roller 57 for the forward and backward feeding motions of the paper 10 is a part of the feeding device such as the paper feeding motor 51, the second gear train 52, the paper supplying roller 55, the platen roller 37, the discharging roller 61 and the pinch roller 62. Based on a detection signal from the detection device that detects the front end 10A of the paper 10 by the front-and-rear-end detection sensor 58 and the control circuit 110 in the forward feeding motion, the pair of the paper feeding roller 56 and the pinch roller 57 tightly hold a predetermined point of the front end 10A of the paper 10 to stop feeding motion of the paper 10 before the front end 10A of the paper 10 is projected through the first paper projection port 19. This makes it possible to prevent dust from adhering to the paper 10, thereby avoiding the entry of dust to or near the printing device such as the thermal head 15, the ink ribbon 45 and the platen roller 37, which can improve the print quality of the paper 10 as the printing medium. Additionally, the pair of the paper feeding roller 56 and the pinch roller 57 tightly hold a predetermined point of the rear end 10B of the paper 10 to stop the feeding motion of the paper 10. This can certainly perform the backward feeding motion of the paper 10.

Further, the first cover 12 is provided with the side covers 12A, 12B along the sides thereof. This can prevent the entry of dust from every direction.

Additionally, the second cover 27 is provided with the side covers 27A, 27B along the sides thereof. This can prevent the entry of dust every direction.

Furthermore, the chamfered depression 27C is provided in the free end 29 of the second cover 27 so that the second engagement portion 14 holds the front end 10A of the paper 10 when the depression 27C swings about the third engagement portion 26 to cover the paper 10 by the pressure of the rear end 10B of the paper 10. This can prevent the paper 10 from being bent downward. Also, the second cover 27 can certainly swing about the third engagement portion 26.

Also, the chamfered projection 27D is provided in the free end 29 of the second cover 27 so that the projection 27D holds the front end 10A of the paper 10 when the depression 27C swings about the third engagement portion 26 to cover the paper 10 by the pressure of the rear end 10B of the paper 10. This can prevent the paper 10 from being bent downward. Also, the second cover 27 can certainly swing about the third engagement portion 26. Additionally, the projection 27D is chamfered, so that the paper 10 can be smoothly discharged outside the housing 7.

The printer 1 further comprises the detection device and a pair of the paper feeding roller 56 and the pinch roller 57. The detection device includes the front-and-rear-end detection sensor 58 and the control circuit 110 to detect the rear end 10B of the paper 10 as the printing medium to be printed. The pair of the paper feeding roller 56 and the pinch roller 57 for the forward and backward feeding motions of the paper 10 is a part of the feeding device such as the paper feeding motor 51, the second gear train 52, the paper supplying roller 55, the platen roller 37, the discharging roller 61 and the pinch roller 62. Based on a detection signal from the detection device that detects the rear end 10B of the paper 10 by the front-and-rear-end detection sensor 58 and the control circuit 110 in the forward feeding motion, the pair of the paper feeding roller 56 and the pinch roller 57 tightly hold a predetermined point of the rear end 10B of the paper 10 to stop the feeding motion of the paper 10 before the rear end 10B of the paper 10 is projected through the second paper projection port 23. This makes it possible to prevent dust from adhering to the paper 10, thereby avoiding the entry of dust to or near the printing device such as the thermal head 15, the ink ribbon 45 and the platen roller 37, which can improve the print quality of the paper 10 as the printing medium. Accordingly, print quality of the paper 10 as the printing medium can be improved. Additionally, the pair of the paper feeding roller 56 and the pinch roller 57 tightly hold a predetermined point of the front end 10A of the paper 10 to stop the feeding motion of the paper 10. This can certainly perform the forward feeding motion of the paper 10.

The printer 1 further comprises the paper tray 11 that stores therein the paper 10 as the printing medium so that the paper 10 is to be drawn out of the paper tray 11 in the forward feeding by the pair of the paper feeding roller 56 and the pinch roller 57 that feed the paper 10 forward and backward, and a return preventing-feeding member such as the guide piece 59 that prevents the paper 10 from returning to the paper tray 11 in the backward feeding motion. This makes it possible to avoid a jam of the paper 10.

Further, the paper 10 is made of the base material which is 0.18 mm or more in thickness, so that the first cover 12 can certainly swing about the first engagement portion 9 unless the paper 10 is bent by the pressure of the front end 10A of the paper 10 against the first cover 12. Likewise, the second cover 27 can certainly swing about the third engagement portion 26 unless the paper 10 is bent by the pressure of the rear end 10B of the paper 10 against the second cover 27.

While the presently exemplary embodiment has been shown and described, it is to be understood that this disclosure is for the purpose of illustration and that various changes and modifications may be made without departing from the scope of the disclosure as set forth in the appended claims.

What is claimed is:

1. A printer comprising:

a printing device;

a printing medium to be printed by the printing device;

a feeding device that feeds the printing medium forward and backward;

a housing that covers the printing device and the feeding device and that is provided with a first engagement portion and a third engagement portion;

a first paper projection port provided in the housing, through which the printing medium is temporarily projected outside the housing;

a first cover arranged to swing about the first engagement portion by pressure of a front end of the printing medium when projected through the first paper projection port in the forward feeding motion by the feeding device to cover the projected printing medium;

a second paper projection port provided in the housing, through which the printing medium is temporarily projected outside the housing; and a second cover arranged to swing about the third engagement portion by the pressure of the rear end of the printing medium when projected through the second paper projection port in the backward feeding motion by the feeding device to cover the projected printing medium;

wherein a chamfered depression is provided in a free end of the second cover to support the rear end of the printing medium when the second cover swings about the third engagement portion by the pressure of the printing medium to cover the printing medium.

2. The printer according to claim 1, wherein the second cover is adapted to be returned by its own weight to a position to close the second paper projection port in the forward feeding motion of the printing medium by the feeding device.

3. The printer according to claim 1, wherein the first cover is provided with a side cover along a side thereof.

4. The printer according to claim 1, wherein a chamfered projection is provided in the free end of the second cover to support the rear end of the printing medium when the second cover swings about the third engagement portion by the pressure of the printing medium to cover the printing medium.

5. The printer according to claim 1, further comprising:

a detection device that detects the rear end of the printing medium, wherein the feeding device includes a pair of rollers that feeds the printing medium forward and backward, and based on a detection signal from the detection device that detects the rear end of the printing medium in the backward feeding motion, the rollers tightly hold a predetermined portion of a front end of the printing medium to stop feeding motion of the printing medium before the rear end of the printing medium is projected through the second projection port.

6. The printer according to claim 5, further comprising:

a tray that stores therein the printing medium so that the printing medium is to be drawn out of the tray in the forward feeding motion by the pair of rollers that feed the printing medium forward and backward: and, a return preventing-feeding member that prevents the printing medium from returning to the tray in the backward feeding motion.

7. The printer according to claim 1, wherein the printing medium is made of a base material that is 0.18 mm or more in thickness.

8. The printer according to claim 1, wherein the first cover is adapted to be returned by its own weight to a position to close the first paper projection port in the backward feeding motion of the printing medium by the feeding device.

9. The printer according to claim 1, wherein the first cover includes a second engagement portion in a free end thereof to hold the front end of the printing medium when the first cover swings about the first engagement portion by the pressure of the printing medium to cover the printing medium.

10. The printer according to claim 1, further comprising:

a detection device that detects the front end of the printing medium, wherein the feeding device includes a pair of rollers that feeds the printing medium forward and backward, and based on a detection signal from the detection device that detects the front end of the printing medium in the forward feeding motion, the rollers tightly hold a predetermined portion of a rear end of the printing medium to stop feeding motion of the printing medium before the front end of the printing medium is projected through the first projection port.

* * * * *